US009506706B2

(12) United States Patent
Higley

(10) Patent No.: US 9,506,706 B2
(45) Date of Patent: Nov. 29, 2016

(54) MAGAZINE FOR FIREARM

(71) Applicant: Sturm, Ruger & Company, Inc., Southport, CT (US)

(72) Inventor: James B. Higley, Dyer, IN (US)

(73) Assignee: STURM, RUGER & COMPANY, INC.

( * ) Notice: Subject to any disclaimer, the term of this patent is extended or adjusted under 35 U.S.C. 154(b) by 0 days.

(21) Appl. No.: 14/795,136

(22) Filed: Jul. 9, 2015

(65) Prior Publication Data

US 2016/0025436 A1 Jan. 28, 2016

Related U.S. Application Data

(60) Provisional application No. 62/028,362, filed on Jul. 24, 2014.

(51) Int. Cl.
*F41A 9/65* (2006.01)
*F41A 9/70* (2006.01)

(52) U.S. Cl.
CPC ... *F41A 9/70* (2013.01); *F41A 9/65* (2013.01)

(58) Field of Classification Search
CPC ..... F41A 9/64; F41A 9/65; F41A 9/66; F41A 9/67; F41A 9/70
USPC ..... 42/7, 49.01, 50; 89/33.1
See application file for complete search history.

(56) References Cited

U.S. PATENT DOCUMENTS

| | | | |
|---|---|---|---|
| 910,276 | A | 1/1909 | Easdale |
| 1,379,989 | A | 5/1921 | Johnson |
| 2,426,563 | A | 8/1947 | Patchett |
| 2,779,249 | A | 1/1957 | Saetter-Lassen |
| 3,290,815 | A | 12/1966 | Edwards |
| 3,381,405 | A | 5/1968 | Edwards |
| 3,399,480 | A | 9/1968 | Rowe |
| 3,410,175 | A | 11/1968 | Johnson et al. |
| 3,707,797 | A | 1/1973 | Ruth |
| 4,279,091 | A | 7/1981 | Edwards |
| 4,667,566 | A | 5/1987 | Bosshard et al. |
| 4,910,904 | A | 3/1990 | Rose |
| 5,031,348 | A | 7/1991 | Carey |

(Continued)

FOREIGN PATENT DOCUMENTS

| | | |
|---|---|---|
| FR | 470223 | 8/1914 |
| FR | 516596 | 4/1921 |

(Continued)

OTHER PUBLICATIONS

Corresponding International Search Report and Written Opinion for PCT/US15/39671 dated Oct. 6, 2015.

*Primary Examiner* — Stephen M Johnson
(74) *Attorney, Agent, or Firm* — The Belles Group, P.C.

(57) ABSTRACT

A magazine for a firearm comprises a tubular body defining a cavity for holding cartridges, a spring, and a follower biased by the spring for dispensing cartridges from the magazine. In one embodiment, the follower includes lateral guide projections which engage corresponding slots in the sidewalls of the magazine body. This guides movement of the follower and maintains a substantial horizontal orientation as it travels vertically in the magazine by preventing twisting/tilting which might otherwise create potential cartridge feeding jams. In some embodiments, the follower may include front and rear stabilizer projections to further guide movement of the follower in the magazine cavity.

22 Claims, 32 Drawing Sheets

(56) References Cited

U.S. PATENT DOCUMENTS

| | | | | |
|---|---|---|---|---|
| 5,263,273 | A | 11/1993 | Lishness | |
| 5,392,553 | A | 2/1995 | Carey | |
| 5,909,002 | A | 6/1999 | Atchisson | |
| 5,941,005 | A | 8/1999 | Battaglia et al. | |
| 5,974,718 | A | 11/1999 | Bentley et al. | |
| 5,983,549 | A | 11/1999 | Battaglia | |
| 6,481,143 | B2 | 11/2002 | McCarthy | |
| 6,732,466 | B2 | 5/2004 | Bentley | |
| 6,829,974 | B1 | 12/2004 | Gwinn, Jr. | |
| 7,478,495 | B1 | 1/2009 | Alzamora et al. | |
| 7,493,845 | B2 | 2/2009 | Mantas | |
| 7,533,483 | B1 | 5/2009 | Alzamora et al. | |
| 7,926,216 | B2 | 4/2011 | Bentley | |
| 8,176,668 | B2 | 5/2012 | Simms et al. | |
| 8,322,063 | B1 * | 12/2012 | Battaglia | F41A 9/71 42/49.02 |
| 8,413,361 | B2 | 4/2013 | Quaedpeerds et al. | |
| 8,505,226 | B2 | 8/2013 | Vesligaj | |
| 2009/0107022 | A1 * | 4/2009 | Fitzpatrick | F41A 9/70 42/50 |
| 2010/0281737 | A1 | 11/2010 | Cahill | |
| 2011/0113663 | A1 | 5/2011 | Nakayama et al. | |
| 2011/0138668 | A1 | 6/2011 | Thomas | |
| 2013/0180146 | A1 | 7/2013 | Fitzpatrick et al. | |
| 2014/0059909 | A1 | 3/2014 | Caudle | |
| 2014/0109452 | A1 | 4/2014 | Baker | |

FOREIGN PATENT DOCUMENTS

| | | | |
|---|---|---|---|
| FR | 2645952 | | 10/1990 |
| GB | 573694 | | 12/1945 |
| GB | 836796 | | 6/1960 |
| WO | WO 2012073052 | * | 6/2012 |

* cited by examiner

MAGAZINE FOR FIREARM

CROSS-REFERENCE TO RELATED APPLICATIONS

The present application claims the benefit of priority to U.S. Provisional Application No. 62/028,362 filed Jul. 24, 2014, the entirety of which is incorporated herein by reference.

The present invention generally relates to firearms, and more particularly to magazines detachably mounted to firearms.

BACKGROUND

Ammunition magazines for firearms are designed to conveniently store and teed multiple rounds of shells or cartridges. Such magazines have a spring mechanism which automatically dispenses the cartridges for firing in many different types of firearm platforms, including shotguns, rifles, and pistols. One type of magazine used is a box style magazine, which may be removably detached to the underside of the firearm below the action. These magazines hold a plurality of vertically stacked cartridges. When the action is cycled, a fresh cartridge is uploaded by the spring mechanism into the breech area from which the bolt or breech block loads the cartridge forward into the chamber for firing.

Smooth and reliable feeding of individual cartridges from the magazine into the action of the firearm is desirable. It is also generally desirable to make magazines as compact as possible without sacrificing the intended cartridge capacity of the magazine.

SUMMARY

According to one aspect, a magazine is provided which is configured to reliably dispense cartridges from the stack without binding of the spring feed mechanism. In one embodiment, the magazine is a box magazine.

According, to another aspect, a box magazine is provided having a compact design. Advantageously, particularly in the case of such a magazine used in long guns such as shotguns and rifles, this minimizes the projection of magazine from the underside of the firearm where mounted resulting in an overall more compact firearm and magazine assembly.

In one aspect, a firearm magazine includes: an elongated tubular body defining a vertical centerline, a longitudinal axis perpendicular thereto, and an interior cavity configured to hold a plurality of ammunition cartridges, the body including an open top end, a bottom end, a front wall, a rear wall, and opposed lateral sidewalls extending along, the longitudinal axis between the front and rear walls; a spring disposed in the cavity; a follower moveably disposed in the cavity and biased in an upwards direction towards the top end by the spring; the follower including a longitudinally extending body, a front end, a rear end, and opposed lateral sides extending along the longitudinal axis between the front and rear ends; and a longitudinally spaced apart pair of front and rear guide projections protruding outwards from each of the lateral sides of the follower in a direction transverse to the longitudinal axis, each guide projection slideably engaging a corresponding vertically elongated guide slot formed in the sidewalls of the tubular body within the cavity for guiding movement of the follower; wherein the follower is moveable from a lower position in the cavity to an upper position in the cavity.

In another aspect, a firearm magazine includes: an elongated tubular body defining a vertical centerline, a longitudinal axis perpendicular thereto, and an interior cavity configured to store a plurality of ammunition cartridges, the body including an open top end, a bottom end, a front wall, a rear wall, and first and second opposing lateral sidewalls extending along the longitudinal axis between the front and rear walls; a spring disposed in the cavity; a follower moveably disposed in the cavity and biased in an upwards direction towards the top end by the spring; the follower including a longitudinally extending body, a front end, a rear end, and opposed lateral sides extending along the longitudinal axis between the front and rear ends; a front stabilizer projection extending downwards from the front end of the follower; a rear stabilizer projection extending downwards from the rear end of the follower; and a first lateral guide projection formed on the first lateral sidewall of the follower; a second lateral guide projection formed on the second lateral sidewall of the follower opposite the first lateral guide projection; each of the first and second lateral guide projections slideably engaging a respective vertically elongated guide slot formed in the first and second sidewalls of the tubular body within the cavity for guiding movement of the follower; wherein the first and second lateral guide projections are vertically moveable in the guide slots when the follower is moved from a lower position to an upper position in the cavity.

In another aspect, a firearm magazine includes: an elongated tubular body defining a vertical centerline, a longitudinal axis perpendicular thereto, and an interior cavity configured to hold a plurality of ammunition cartridges, the body including an open top end, a bottom end, a front wall, a rear wall, and opposed lateral sidewalls extending along the longitudinal axis between the from and rear walls; a spring, disposed in the cavity; a follower moveably disposed in the cavity and biased in an upwards direction towards the top end by the spring; the follower including a longitudinally extending body, a front end, a rear end, and opposed lateral sides extending alone the longitudinal axis between the from and rear ends; and a front stabilizer projection extending downwards from the front end of the follower; a rear stabilizer projection extending downwards from the rear end of the follower; and a longitudinally spaced apart pair of front and rear guide projections protruding outwards from each of the lateral sides of the follower in a direction transverse to the longitudinal axis, each guide projection slideably engaging a corresponding vertically elongated guide slot formed in the sidewalls of the tubular body within the cavity for guiding movement of the follower; wherein the follower is moveable from a lower position in the cavity to an upper position in the cavity.

BRIEF DESCRIPTION OF THE DRAWINGS

The features of the exemplary embodiments will be described, with reference to the following drawings where like elements are labeled similarly, and in which.

Figure 2:
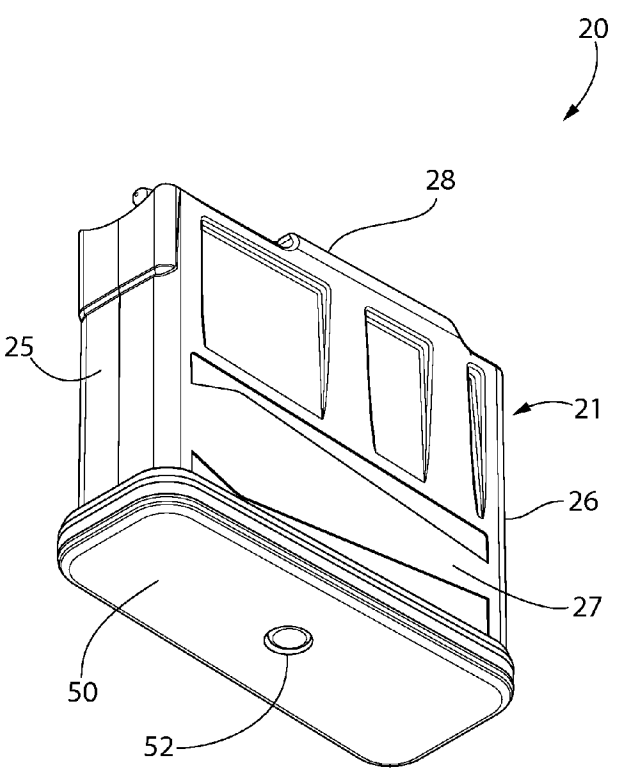
FIG. 2 is a bottom front perspective view thereof.
Figure 1:
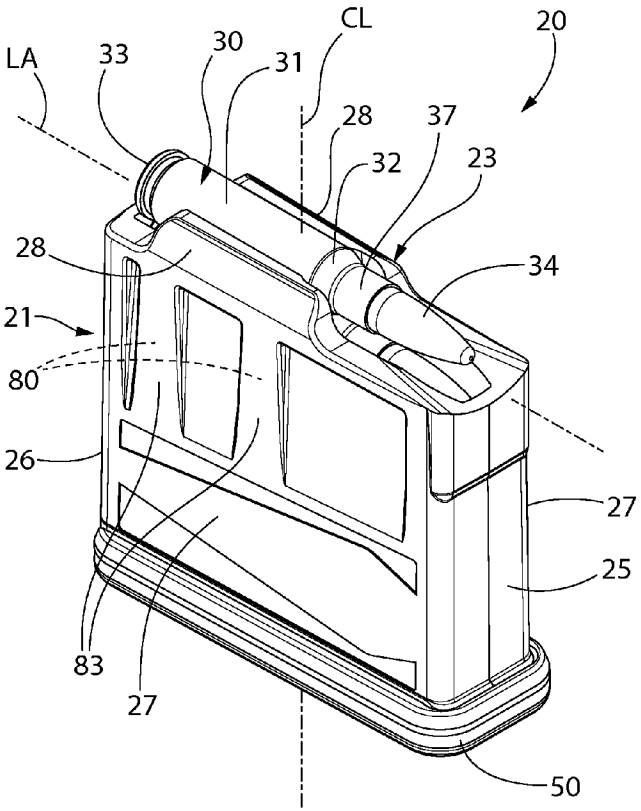
FIG. 1 is a top front perspective view of a firearm magazine according to the present disclosure loaded with a staggered stack of ammunition cartridges.
Figure 3:
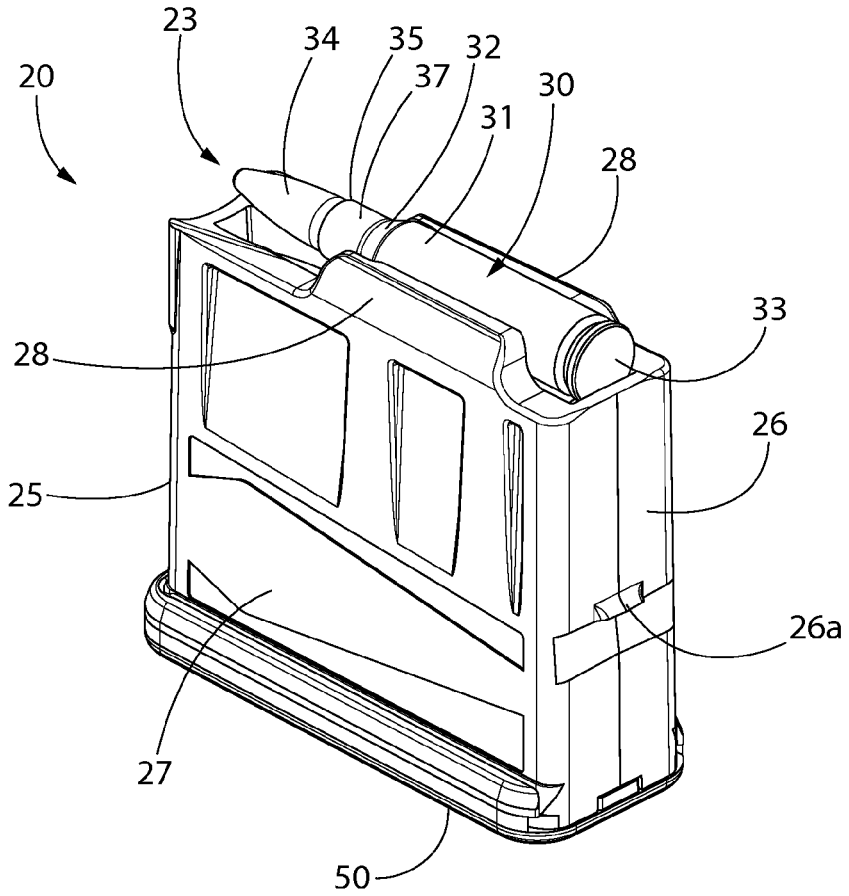
FIG. 3 is a top rear perspective view thereof.
Figure 4:
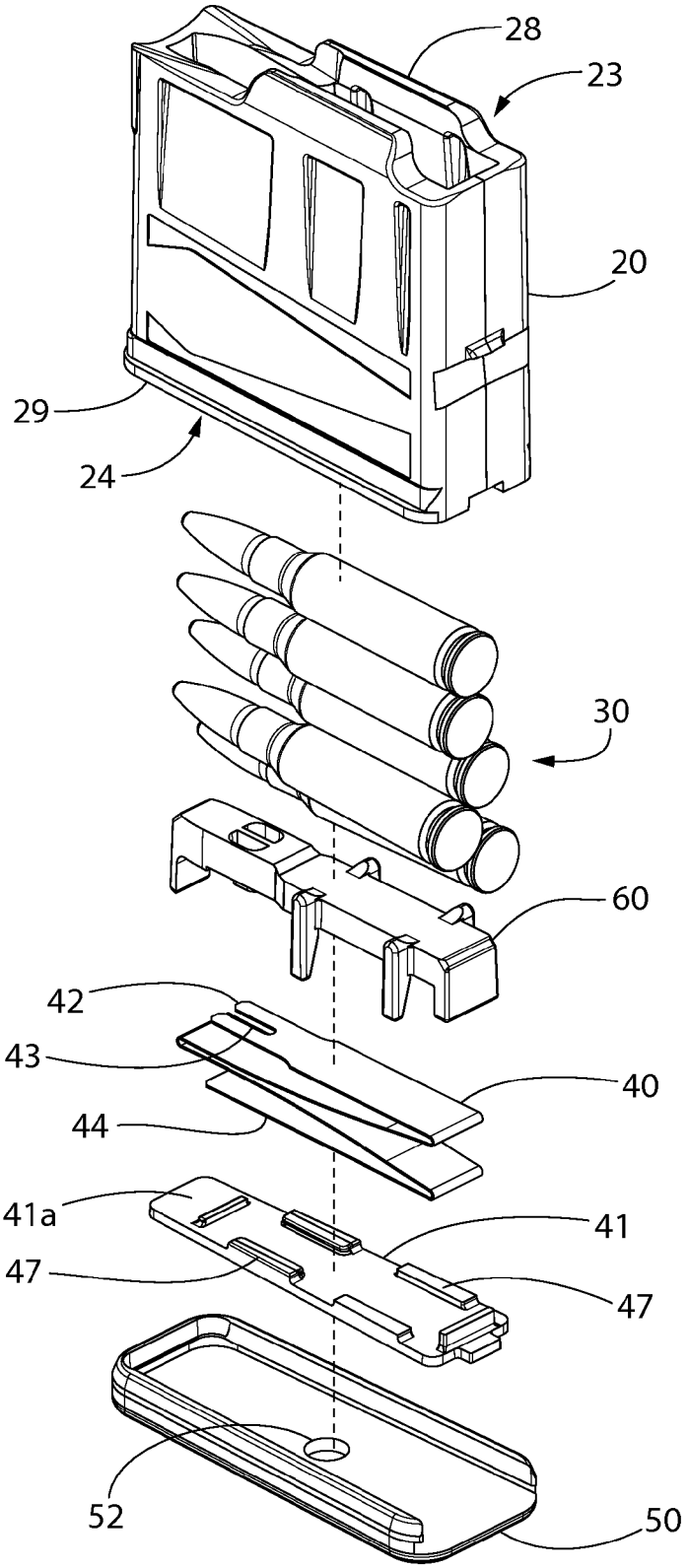
FIG. 4 is an exploded perspective view thereof.
Figure 6:
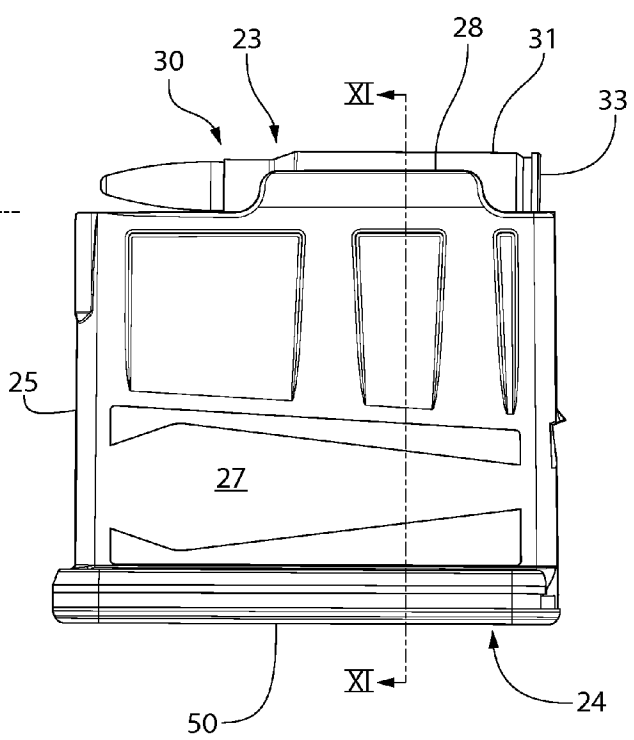
FIGS. 5 and 6 are right and left side views thereof.
Figure 5:
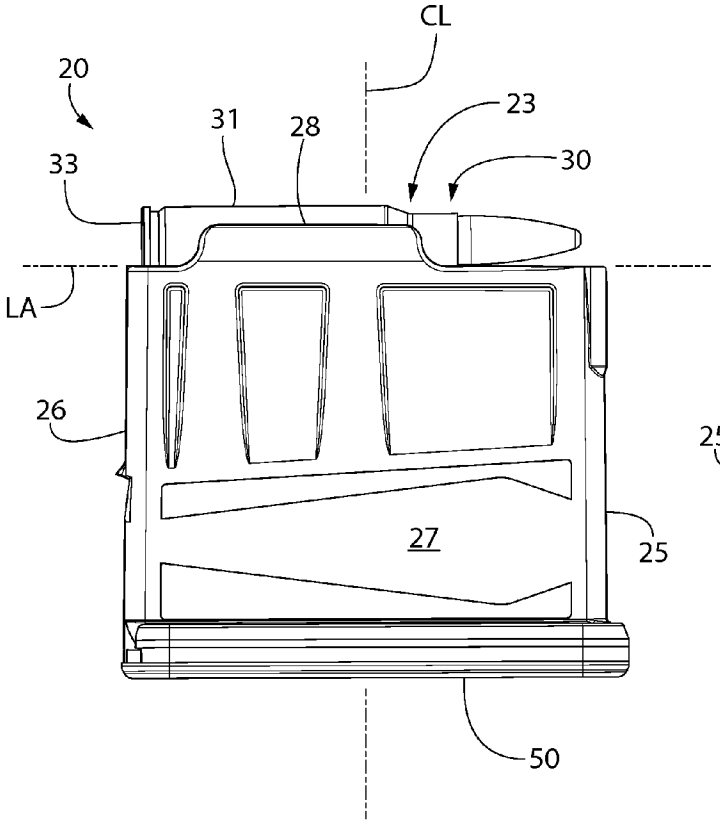
Figure 7:
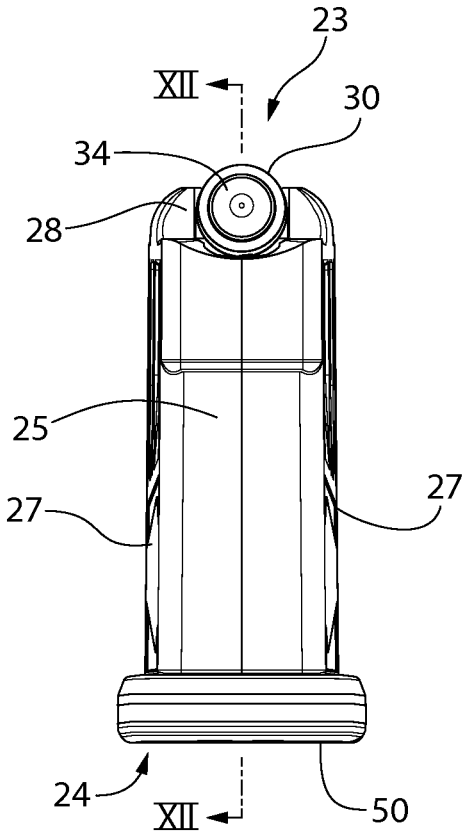
FIGS. 7 and 8 are front and rear elevation views thereof.
Figure 8:
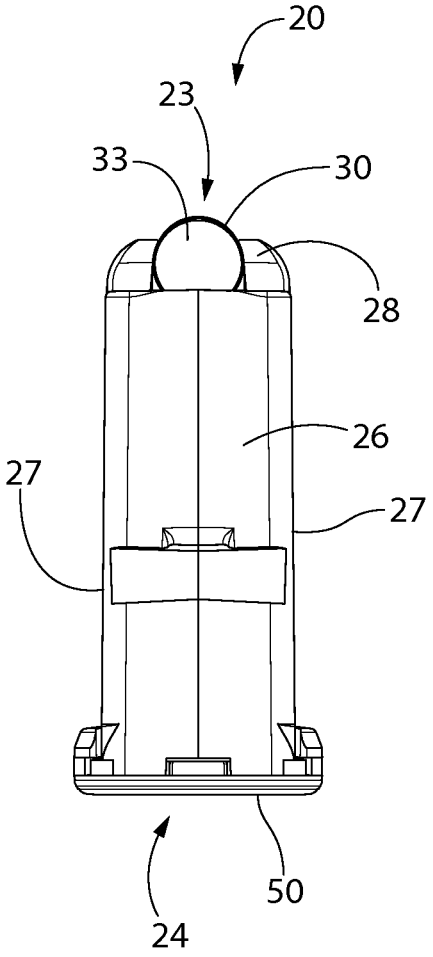
Figure 9:
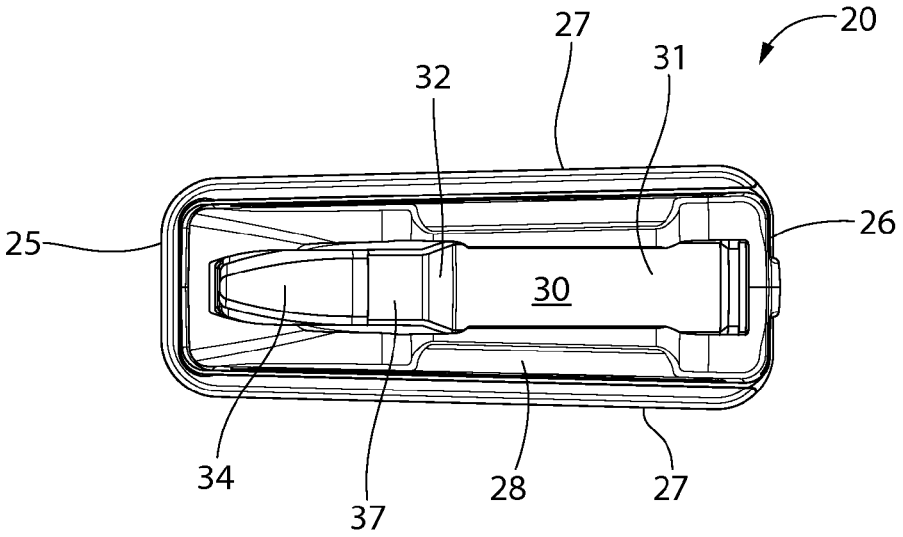
FIGS. 9 and 10 are top and bottom plan views thereof.
Figure 10:
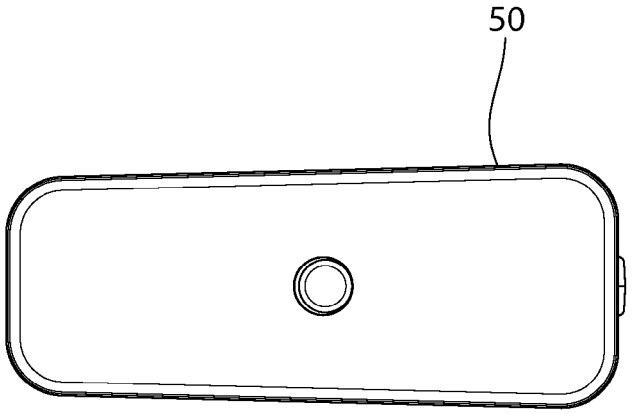

All drawings are schematic and not necessarily to scale. Parts given a reference numerical designation in one figure may be considered to be the same parts where they appear in other figures without a numerical designation for brevity unless specifically labeled with a different part number and/or described herein.

DETAILED DESCRIPTION

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible nonlimiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below." "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

The terms "shell" and "cartridge" are used interchangeably herein in reference to describing ammunition, and therefore should not to be construed as limiting the invention or the claims appended hereto. For convenience and brevity, further description of ammunition which follows will use the non-limiting term of "cartridge."

A detachable firearm magazine according to a non-limiting embodiment is described which may be used in autoloading long guns such as rifles or shotguns, or other types of autoloading firearms including pistols. The type of autoloading firearm does not limit the scope or applicability of the invention.

FIGS. 1-20 show one non-limiting embodiment of a detachable box style magazine for a firearm, which incorporates anti-tilting elements that minimize or eliminate twisting/tilting, of the follower as it moves upwards or downwards in the magazine body. The magazine 20 has an elongated open tubular housing or body 21 that defines an internal cavity 22 configured for holding a plurality of cartridges 30. The cartridges may be held in vertically stacked relationship comprised of either a staggered column or stack (i.e. each cartridge is laterally offset slightly from the preceding cartridge below, shown in FIG. 12), a straight column or stack (i.e. each cartridge is vertically aligned with the rest of the cartridges in the stack), or a combination where a staggered stack ends in a single stack near the top of the magazine for dispensing.

The body 21 of the magazine 20 may have an axially vertically elongated rectangular shape (in transverse cross section) defining a vertical centerline CL and a longitudinal axis LA extending perpendicular thereto in an axial direction. The magazine body comprises a partially open top end 23, open bottom end 24, front wall 25, rear wall 26, and pair of opposing spaced part sidewalls 27 extending therebetween along the longitudinal axis. The walls 25-27 may be substantially straight in one embodiment. The magazine body 21 may be formed of a suitable preferably lightweight metallic or non-metallic material such as without limitation a metal (e.g. aluminum) or a polymer.

The top end 23 of the magazine is substantially open and includes a pair of inwardly angled or curved cartridge feed lips 28 which engage and retain the uppermost cartridge 30 in the stack. This prevents the column or stack of cartridge from being vertically ejected by the spring feed mechanism further described herein. In one embodiment, the feed lips 28 are configured and positioned to engage the generally straight portion of cartridge case between the angled shoulders and rear head or base of the cartridge at the primer cap end (see, e.g. FIG. 1).

The cartridge 30 may be a centerfire cartridge in some embodiments including the base 33 having an annular extraction rim 36 and the centered primer cap, bottle-shaped case 31 including a straight portion, diametrically narrow neck 37, and angled shoulders 32 therebetween. A projectile 34 (e.g. slug or bullet) is inserted and mounted in the open neck end of the cartridge. Other configurations and/or types of cartridges may be used.

The feed lips 28 extend axially from a point proximate the rear wall and terminate at a point spaced rearward from the front wall by a sufficient horizontal distance to allow the cartridges to be axially removed from or inserted into the magazine beneath the feed lips. In one embodiment, the feed lips may terminate approximately midway between the front and rear walls of the magazine.

The magazine 20 is configured for detachable mounting into a magazine well or space formed in the underside (bottom) of the firearm. The magazine may be locked into the firearm via a spring loaded latch mechanism provided with the firearm. In one embodiment, the rear wall 26 of magazine 20 has a protruding lip or catch 26*a* (see, e.g. FIGS. 3 and 25) configured and arranged to engage the latch mechanism of firearm. The latch mechanism is operated via a release button or lever on the side or underside of the receiver near the magazine. The latch mechanism locks the magazine in position for use and releases/drops the magazine via operation of the release button/lever for exchanging magazines. Such magazine latch mechanisms and their operation are well known in the art without undue elaboration. An example is shown in U.S. Patent Application Publication 2014/0325886 (application Ser. No. 14/270, 169), which is incorporated herein by reference in its entirety.

Figure 26:
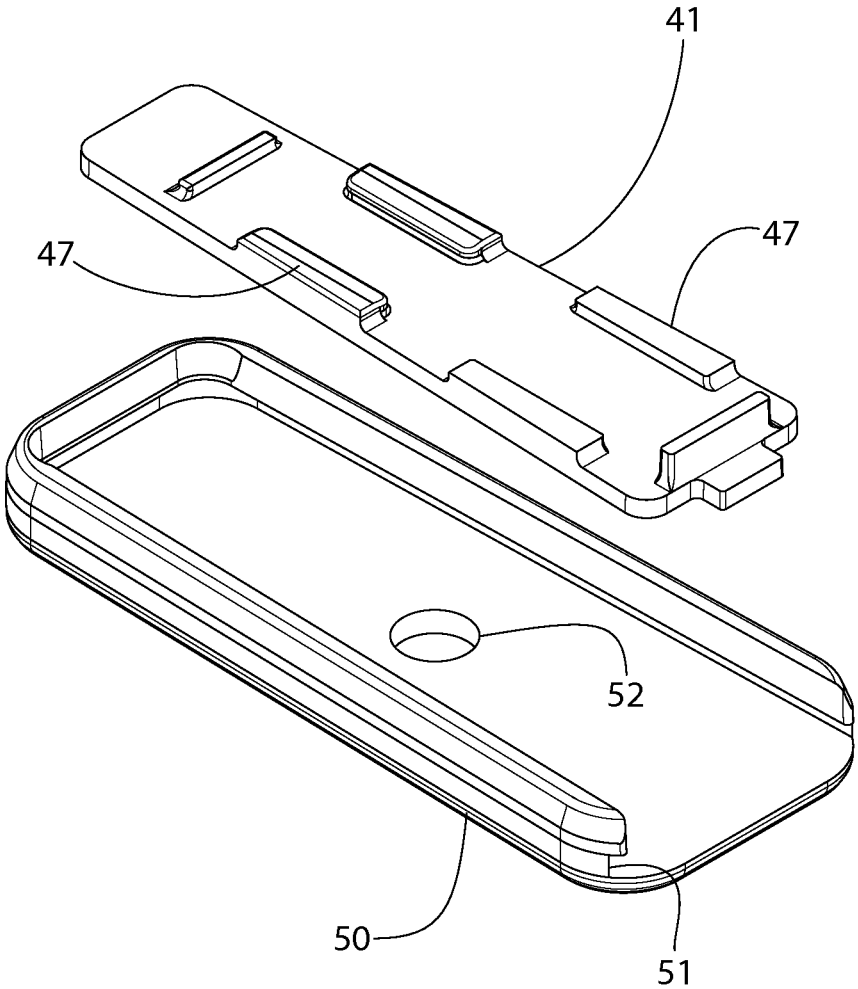
FIG. 26 is an exploded top perspective view of the spring retention plate and bottom closure plate of the magazine.
Figure 27:
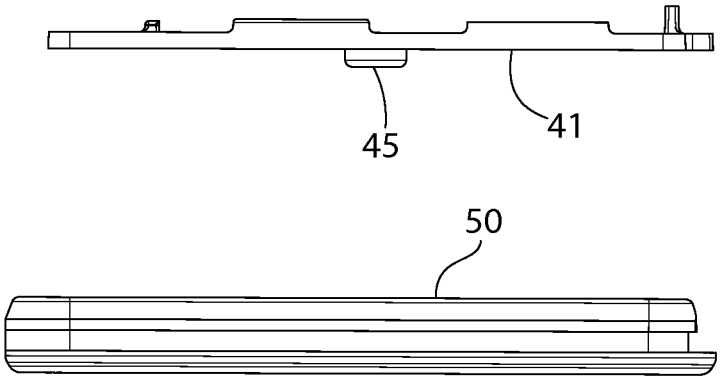
FIG. 27 is side view thereof.
Figure 33:
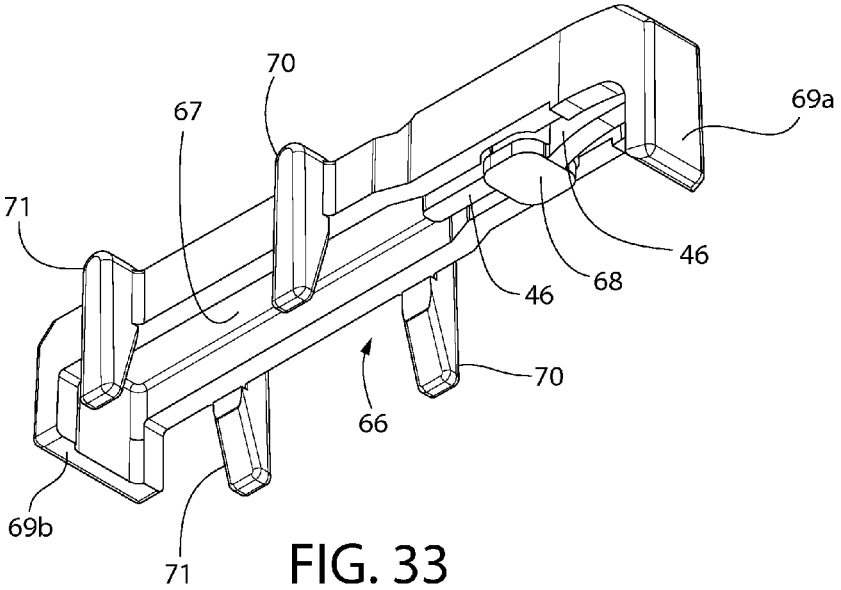
Figure 34:
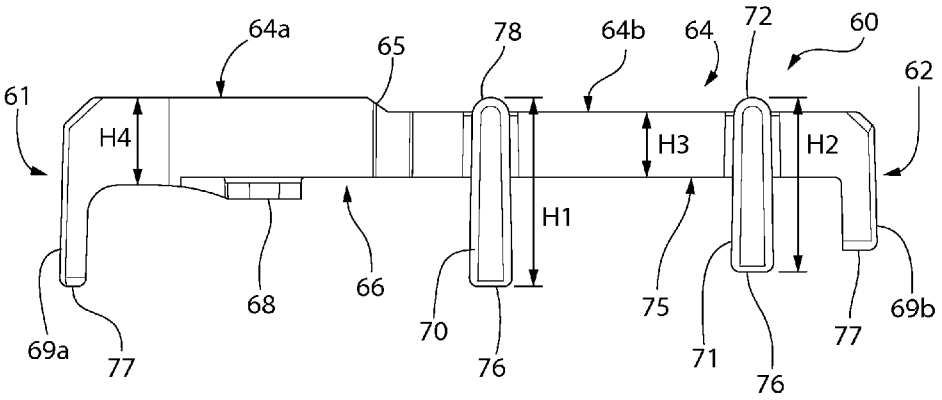
Figure 35:
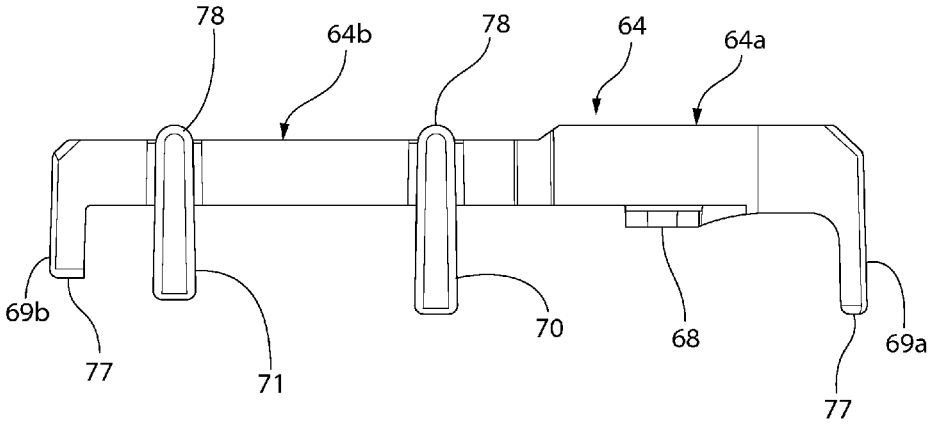
Figure 36:
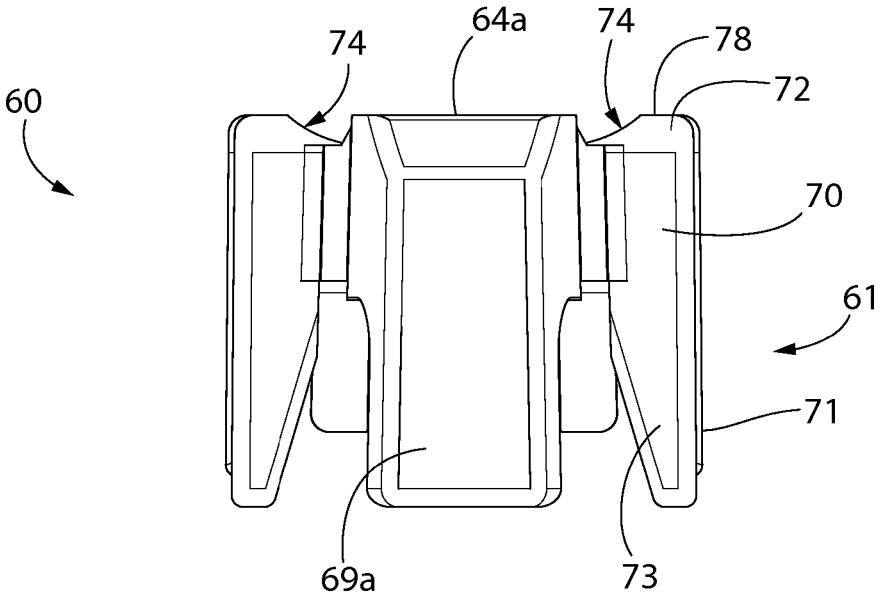
Figure 37:
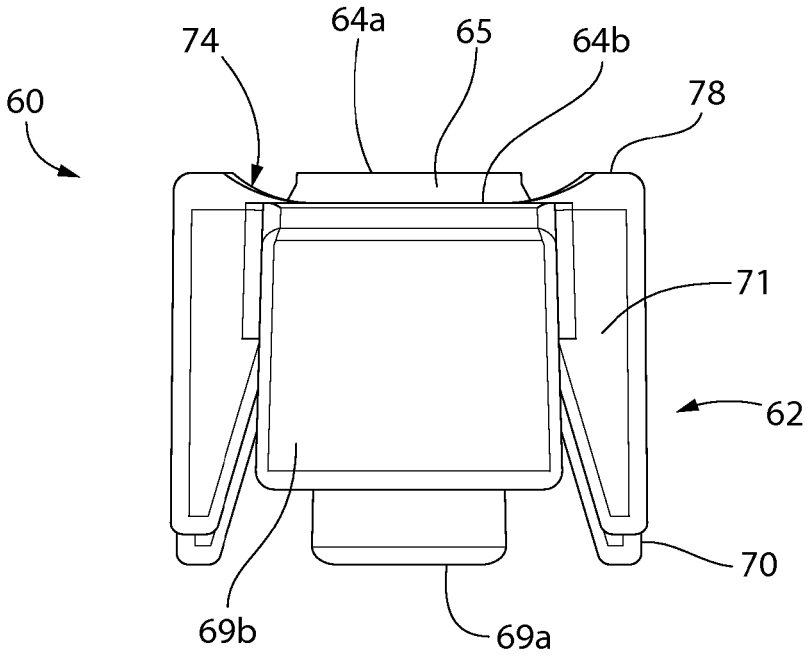
Figure 39:
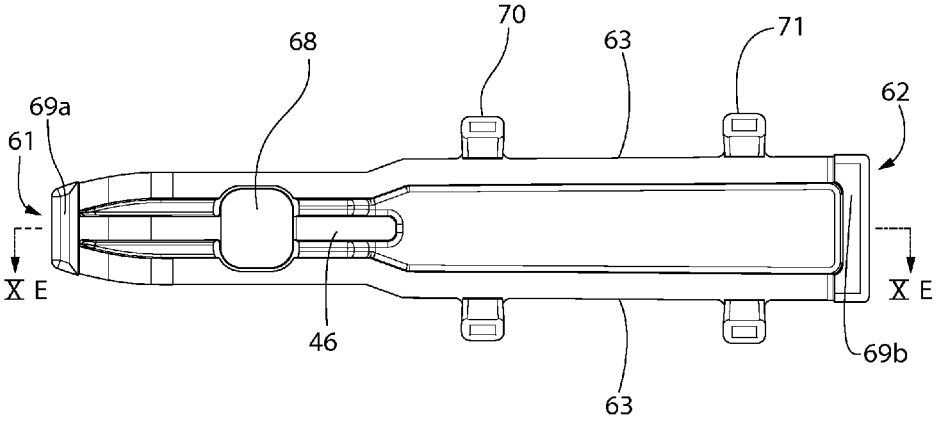
Figure 40:
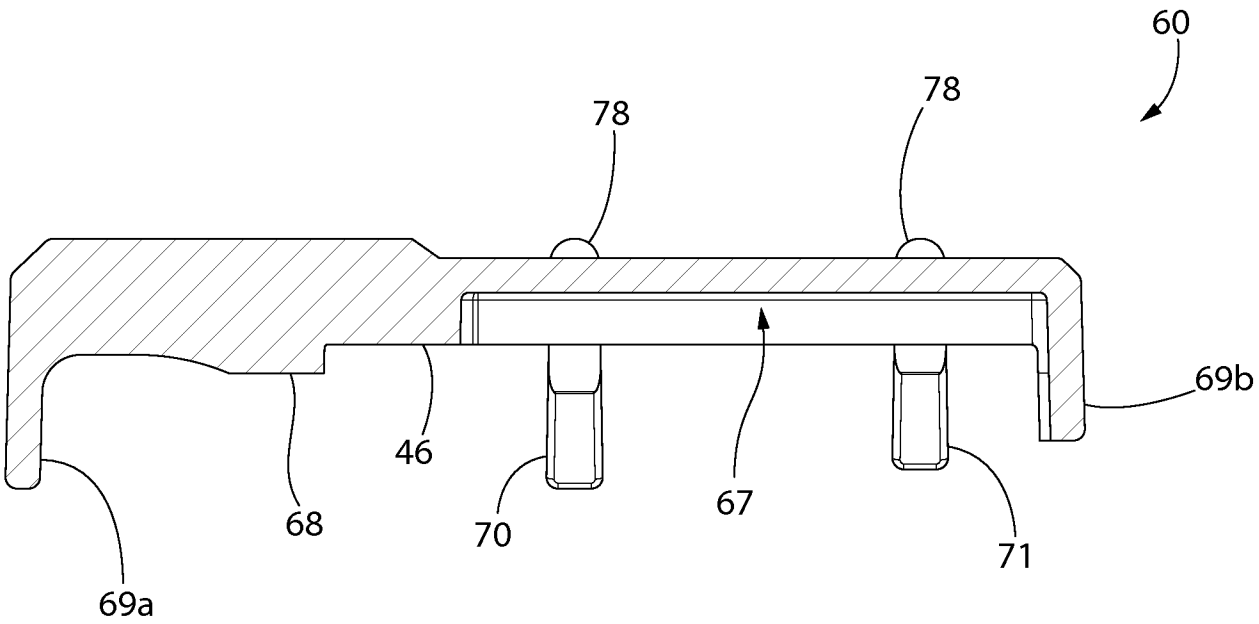

The magazine 20 further includes an internal spring feed mechanism, such as that shown in FIGS. 4, 11, 13, 14, 15, and 16. The spring mechanism is disposed in the cavity 22 of the magazine body 21. The feed mechanism may include an axially elongated follower 60, spring 40, and axially elongated spring retainer plate 41 which attaches to floor plate 50. The spring, biases the follower and stack of cartridges supported thereon upwards towards the open top end 23 of the magazine. In one embodiment, the spring 40 may be a double V-type spring formed from a double folded flat spring material. In some embodiments, the spring 40 may be a constant force spring. The top leg 42 or end of the spring engages the underside or bottom surface of the follower 50. In one embodiment, the top leg 42 may be bifurcated and includes an endwise open mounting slot 43 which is axially elongated. The slot 43 receives and engages a spring retention ridge 46 formed on the bottom surface of the follower for securing the top end of the spring (see FIGS. 13, 33, and 39). The bottom leg 44 or end of the spring engages the retainer 41. In one mounting arrangement, the retainer plate 41 may have one of more pairs of inwardly extending tabs 47 that slideably engage the bottom leg 44 of the spring 40 for securing the spring thereto (see also FIG. 26). The top and bottom legs 43, 44 of the spring 40 may be fixedly (but releasably in some embodiments) attached to the follower 60 and retainer plate 41 respectively in one embodiment allowing the completed spring, follower, and retainer plate assembly to be formed prior to insertion into the magazine through the open bottom 24 prior to installing the floor plate 50.

Other suitable types of spring may be used to bias the follower upwards in the magazine towards the top end, including without limitation coil or compressions springs formed from oblong or circular spring coils. Some embodiments may include more than one spring. Accordingly, the invention is not limited by the type or number of springs used.

Alternatively, the retainer plate 41 may be omitted in some embodiments and directly attached to the floor plate 50. By eliminating the retainer plate, the height of the magazine advantageously may be reduced thereby forming a more compact design. This also reduces the number and cost of components of the magazine.

Figure 28:
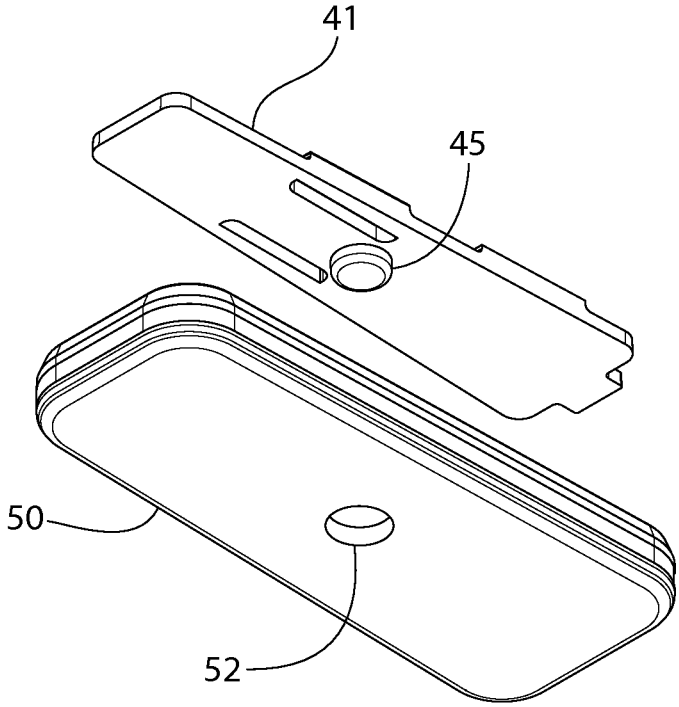
FIG. 28 is an exploded bottom perspective view thereof.
Figure 29:
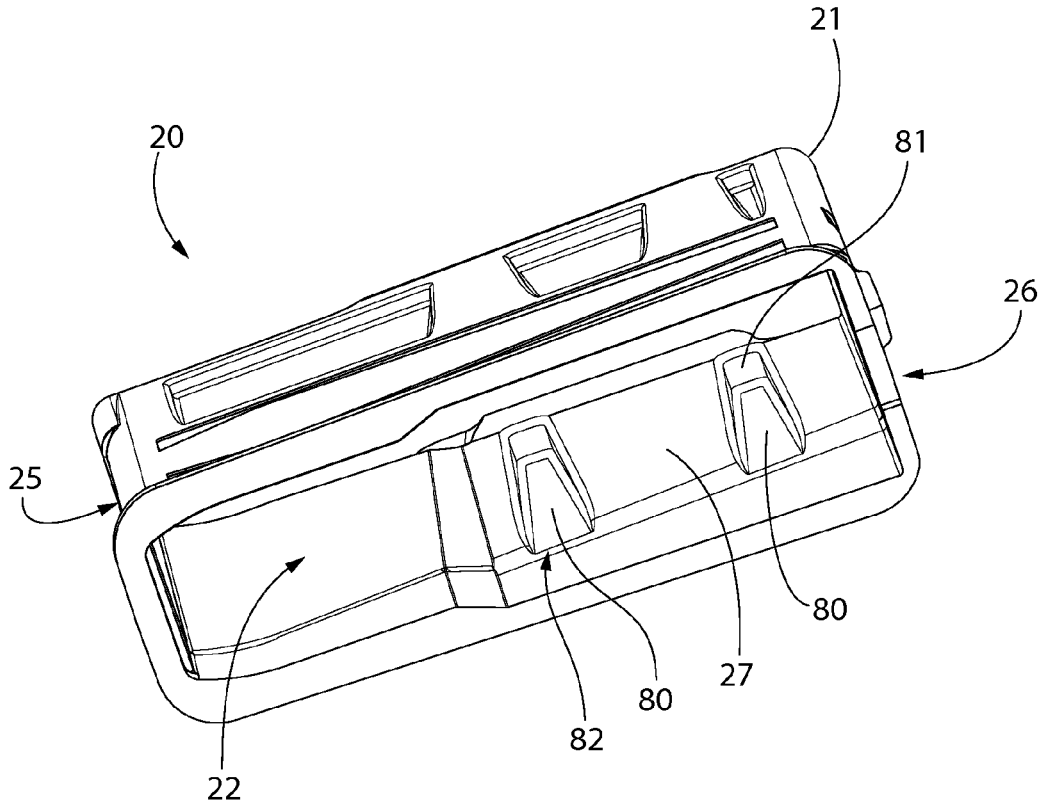
FIG. 29 is a bottom perspective view of the magazine body or housing alone.

Referring to FIGS. 4, 11-13, 17-18, 20, 23-24, the floor plate 50 is configured for attachment to the bottom end 24 of the magazine body 21 and closes the otherwise open end 24. In one embodiment, the floor plate. 50 may be detachably mounted to the magazine. Any suitable mounting method may be used. In the non-limiting embodiment shown, the bottom end 24 of the magazine body 21 may include a pair of outwardly flared lateral flanges 29 which slideably engage a mating pair of axially elongated lateral grooves 51 formed in the sides of the floor plate 50. The floor plate 50 may be slid rearwards onto the bottom end of the magazine from the front wall 25, thereby engaging the flanges 29 with the grooves 51. The rear ends of the grooves 51 are open to insert the flanges therein (see FIG. 23). The floor plate further serves to hold spring retainer plate 40 in position in the bottom of the magazine. In one embodiment, the bottom of the retainer plate 40 may include a downwardly extending round protrusion 45 which mechanically engages a mating round hole 52 in the floor plate 50 (see, e.g. FIG. 28). Other means of attaching the retainer plate to the floor plate may be used.

Referring initially and generally to FIGS. 4, 11-16, 18, 21-25, and 32-40, the follower 60 will now be further described. The follower 60 has a body that is axially elongated in the direction of the longitudinal axis LA of the magazine 20 when mounted therein. The follower 60 includes a top surface 64, bottom surface 66, front end 61, rear end 62, and pair of opposed lateral sides 63 extending axially along the longitudinal axis between the front and rear ends.

Figure 11:
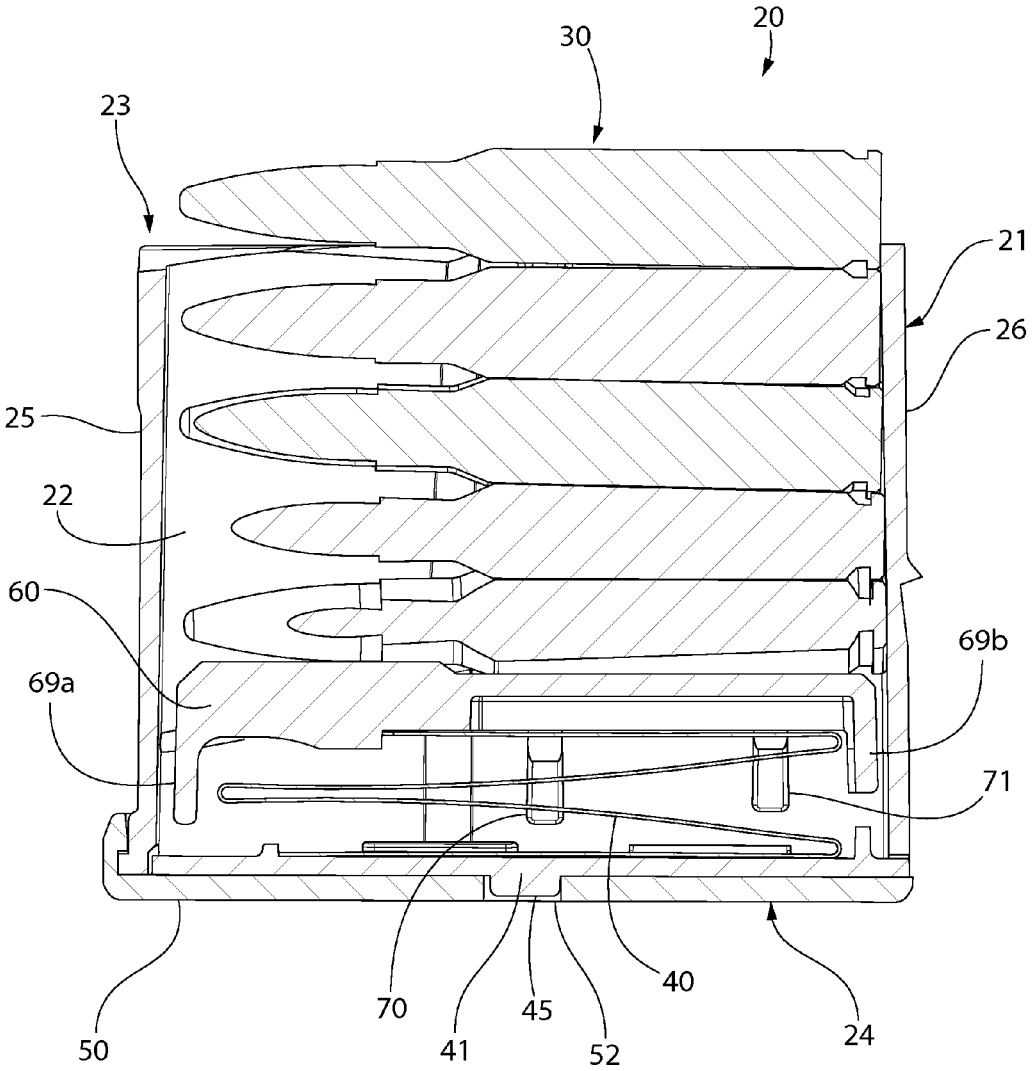
FIG. 11 is a side longitudinal cross-sectional view thereof taken along line XI-XI in FIG. 7.

The top surface 64 of the follower 60 supports the lowermost cartridge 30 in the stack and may have a stepped configuration from front to rear in some embodiments to conform to the stepped shape of bottlenecked centerfire cartridges 30 having shoulders 32 (see FIG. 11). The shape of the follower top surface may therefore be complementary configured to the shape of the cartridge 30 in side profile. Mutual contact is created between a majority of the length of the cartridge case 31 and top surface 64 of the follower to prevent fore and aft wobbling or tilting of the cartridge stack in magazine 20. This helps promote jam-free operation of the cartridge feed mechanism. Accordingly, stepped embodiments of the follower may thus include a top surface having a raised front upper surface portion 64*a* proximate to front end 61 of the follower and a rear lower surface portion 64*b* proximate to rear end 62. The respective longitudinal lengths of the upper and lower surface portions 64*a*, 64*b* may be selected to match the cartridges to be stored in the magazine. Accordingly, the length of the front upper surface portion 64*a* may be less than the length of the rear lower surface portion 64*b* commensurate with the dimensions of a centerfire cartridge having a longer case than neck and projectile. The top surface portions 64*a*, 64*b* may be substantially flat or planar in one embodiment. An angled transition 65 generally coinciding with the location of the cartridge shoulder 32 may be formed between the upper and lower surface portions 64*a*, 64*h* in some embodiments. In other possible embodiments, the entire top surface 64 of follower 60 however may be substantially planar or flat or concave or convex from front to rear end.

Figure 30:
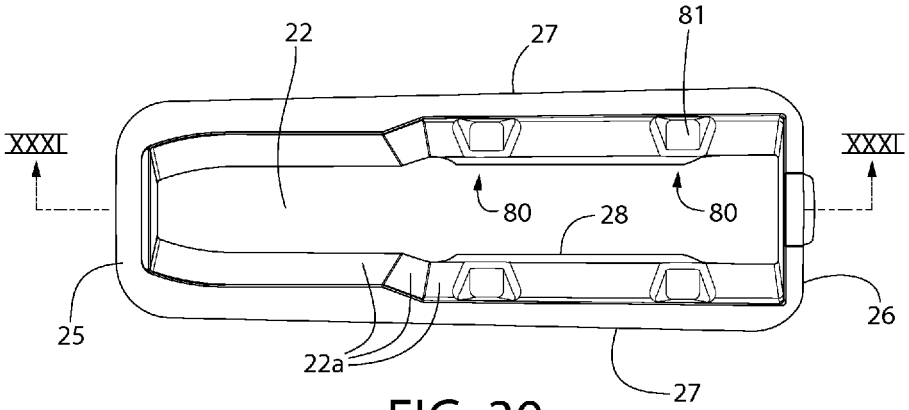
FIG. 30 is a bottom view thereof.
Figure 38:
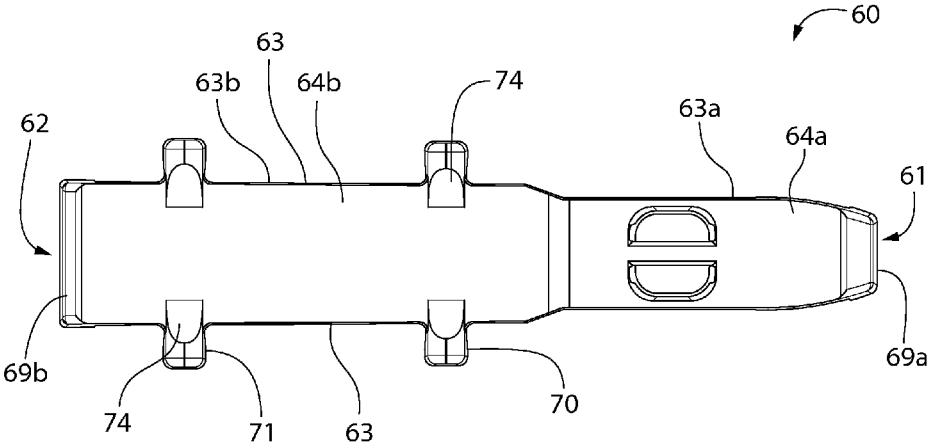

In one configuration, the portion of the lateral sides 63 of the follower adjacent the lower surface portion 64*b* of top surface 64 may be laterally wider than the lateral side portions adjacent the front upper surface portion 64*a* (see, e.g. FIG. 38). This configuration complements the shape of a centerfire cartridge 30 and shape of the internal cavity 22 of the magazine 20 in one embodiment (see, e.g. FIG. 30). The interior surfaces 22*a* of the cavity 22 may gradually converge going from the bottom of the magazine moving to the top of the magazine for better centering and positioning of the uppermost cartridge 30 for stripping by the action and chambering (see also FIG. 12). The opening in the top end 23 of magazine 20 below the feed lips may be slightly larger than the width of a single cartridge 30 for positive, dispensing action.

In some embodiments, a portion of the bottom surface 66 of the follower 60 may be recessed and disposed within a longitudinally extending channel 67 formed in the bottom of the follower. The body of the follower 60 may therefore be U-shaped in some embodiments in transverse cross section (see, e.g. FIG. 33). The channel 67 provides a space for seating and securing the top leg 42 of the spring 40 to the follower 60 (see also FIG. 13). The channel 67 is complementary configured in shape and dimension with the top leg 42 to prevent longitudinal and lateral movement with respect to the underside of the follower. The spring retention ridge 46 is formed within the front portion of the channel 67 and positioned to engage the forked end (slot 43) of the spring. An enlarged boss 68 disposed at the forward end of the retention ridge 46 may be provided to help hold the magazine spring in place. In certain embodiments, a space is formed between the enlarged boss 68 and the body of the follower 60 above the boss to allow each terminal ends of the bifurcated top leg 42 of the spring to slide beneath and be trapped under the boss. This prevents the top end of the spring from separating vertically from the follower when in operation.

Figure 41:
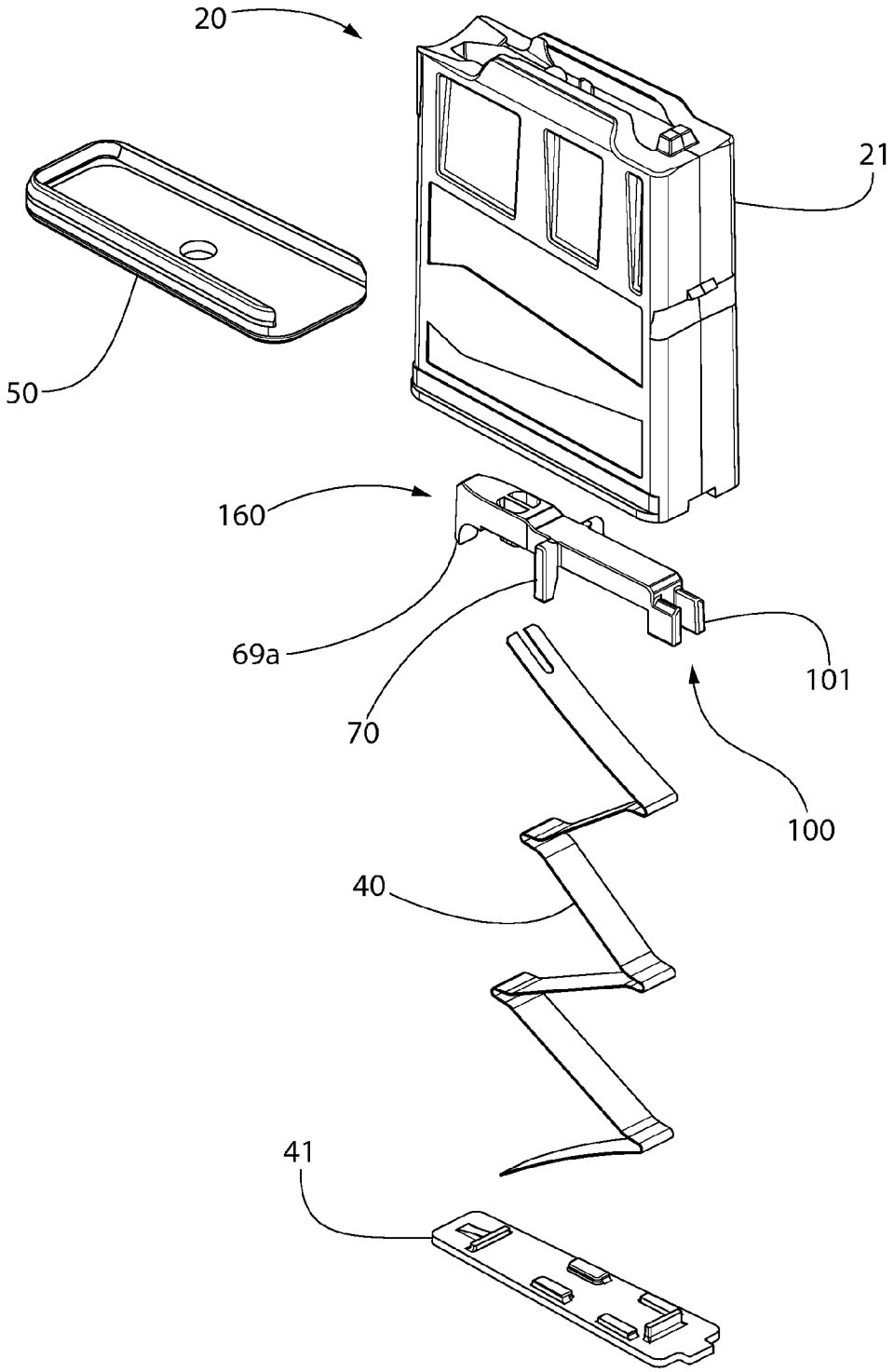
FIG. 41 is an exploded bottom perspective view of the magazine.
Figure 42:
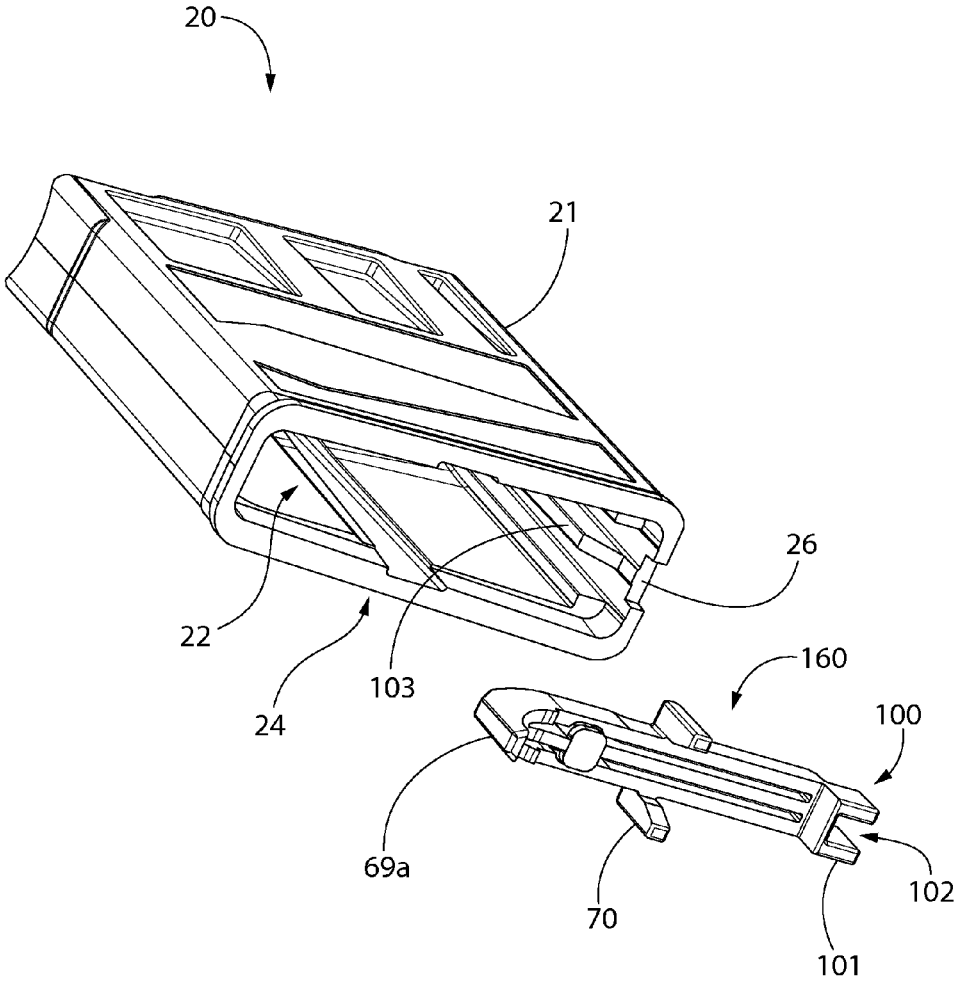
FIG. 42 is an exploded bottom perspective view of the magazine housing and follower.
Figure 43:
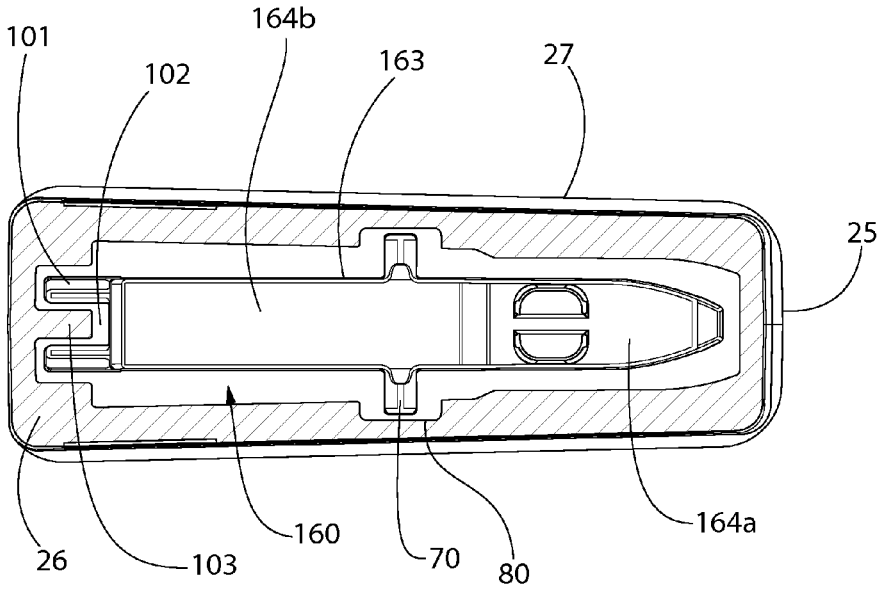
FIG. 43 is a top plan view of the magazine housing and the follower.

According to an aspect of the present invention, the follower 60 includes anti-tilting elements that guide travel of the follower upwards/downwards in the magazine body 21 to minimize or eliminate tilting or twisting of the follower and potential cartridge feed jams may include at least two opposing lateral guide projections 70 on opposite sides 63 of the follower (see, e.g. FIGS. 41-43). The guide projections 70 act to maintain the follower 60 in a substantially horizontal position during travel upwards/downwards in the magazine body 21. In other embodiments shown in FIGS. 32-40, two longitudinally spaced pairs of opposed lateral guide projections 70, 71 may be provided on each side 63 of the follower to further resist twisting or tilting. The guide projections 70 may be considered front guide projections and the guide projections 71 may be considered rear guide projections.

Referring now to FIGS. 32-40, the guide projections 70, 71 are formed on the opposing lateral sides 63 of the follower 60 between the front and rear ends 61, 62. In one embodiment, the guide projections 70, 71 are disposed on the rear half of the follower (i.e. between the transition 65 and rear end 62), and positioned on the lower surface portion 64*b* of the follower top surface 64 in designs having a stepped construction as described herein. The pairs of guide projections 70, 71 on each side of the follower are axially spaced apart along the longitudinal axis LA.

Each lateral guide projection 70, 71 protrudes laterally outwards from the lateral sides 63 of the follower in a direction transverse and perpendicular to the longitudinal axis LA. Vertically, the guide projections 70, 71 may further have upward extensions 72 that protrude upwards beyond the top surface 64 (i.e. lower surface portion 64*b*) of the follower and downward extensions 73 that protrude downwards below the bottom of the follower in some embodiments. Accordingly, the guide projections 70, 71 have a vertical height H1, H2 respectively which is greater than the overall height H3 of the rear lower surface portion 64*h* of the follower on which the projections are disposed, and in some embodiments also a greater height than the height 144 of the front, upper surface portion 64*a* (see FIG. 34). In certain embodiments, heights H1 and H2 may be at least twice the height H3, and also may be at least twice the height 144. The downward extensions 73 of the guide projections 70, 71 may further extend vertically downwards from the bottom edge 75 of the follower 60 by a distance greater than the overall height H3 of the rear lower surface portion 64*b*. In one embodiment, the downward extensions 73 of the guide projections protrude downwards from the body of the follower by a distance greater than the upward extensions 72 of the guide projections protrude upwards.

The top upward extensions 72 of the guide projections define opposing, pairs of inward facing arcuately curved or angled cartridge support surfaces 74. The four support surfaces 74 are arranged to engage the larger diameter straight portions of the bottlenecked cartridge case 31. A pair of support surfaces 74 on one lateral side of the follower 60 or the other engages the case 31 of the lowermost cartridge 30 in a staggered stack arrangement of cartridges (see FIG. 12). The lowermost cartridge is urged into engagement with the support surfaces by a single or stack of cartridge(s) due to the upwards biasing force of the spring acting on the bottom of the follower.

Figure 16:
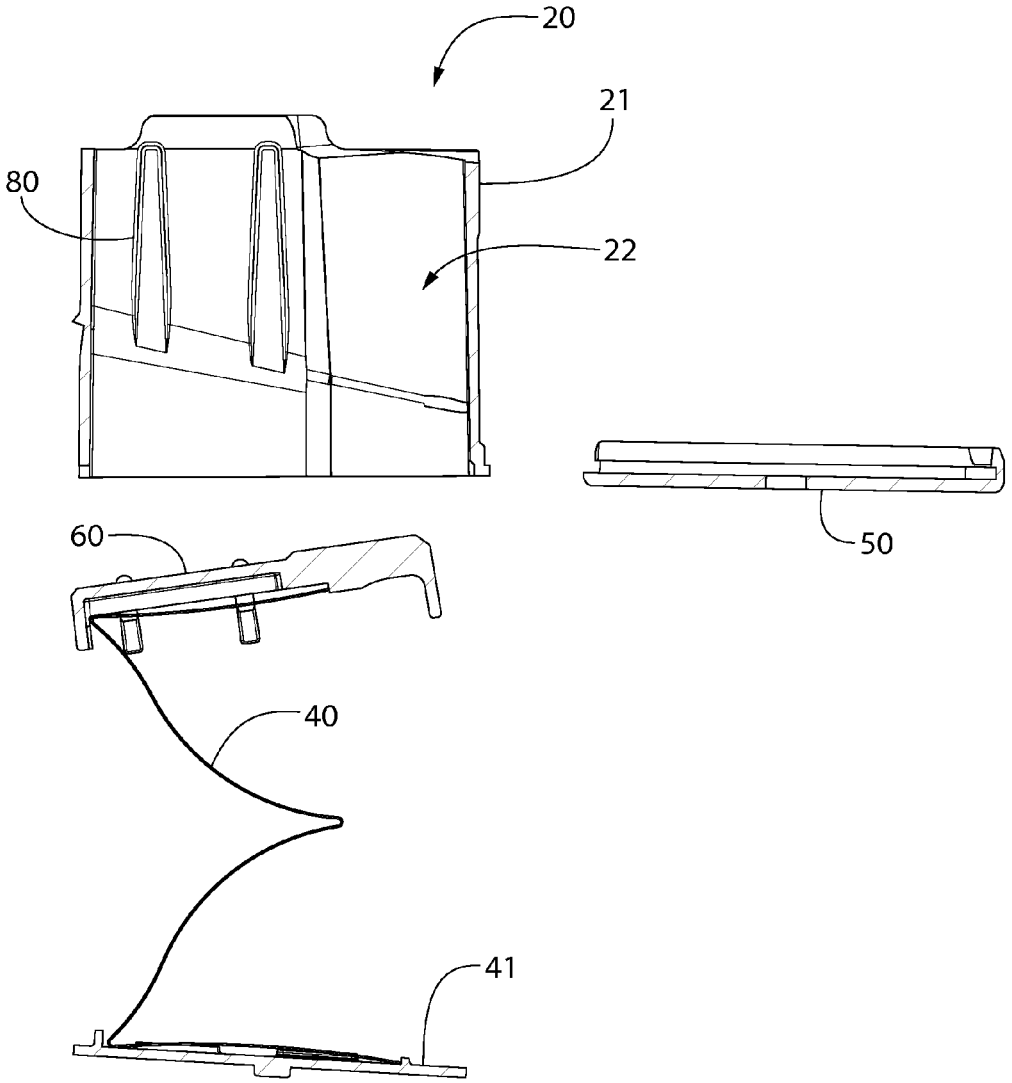
FIG. 16 is a longitudinal cross-sectional view thereof taken along line XVI-XVI in FIG. 15.
Figure 17:
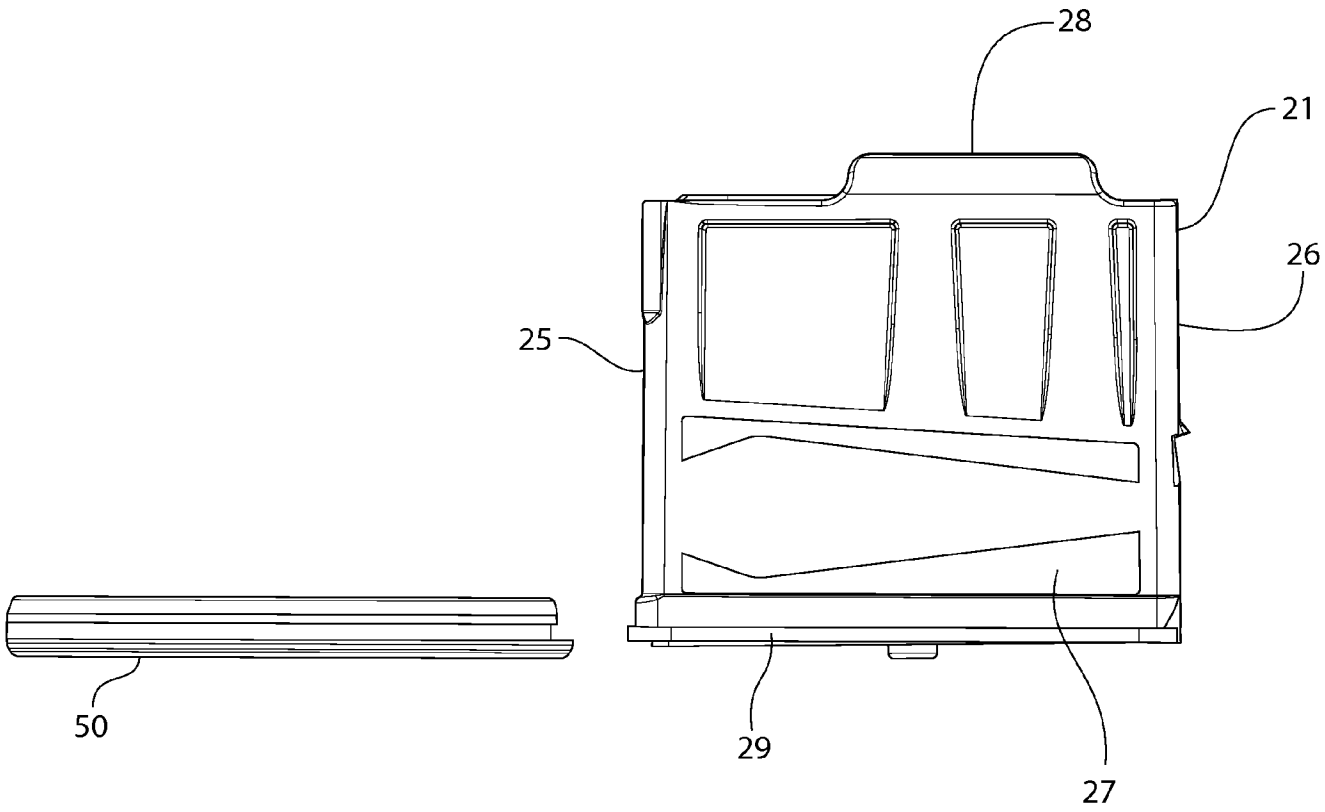
FIG. 17 is a left side view of the magazine with base plate removed.
Figure 18:
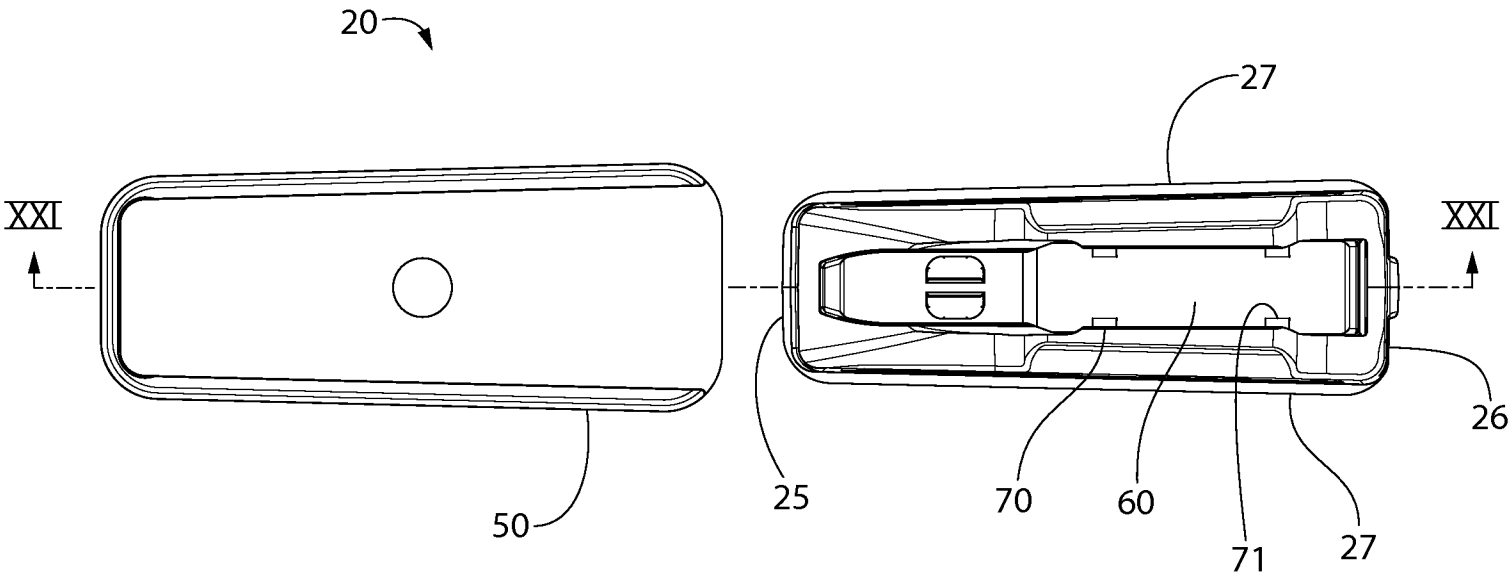
FIG. 18 is a top plan view thereof.
Figure 20:
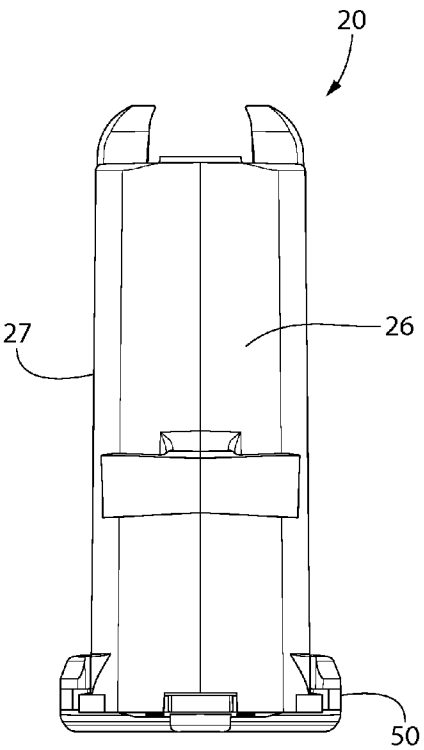
FIGS. 19 and 20 are front and rear elevation views thereof with the base plate mounted on the magazine tube.
Figure 19:
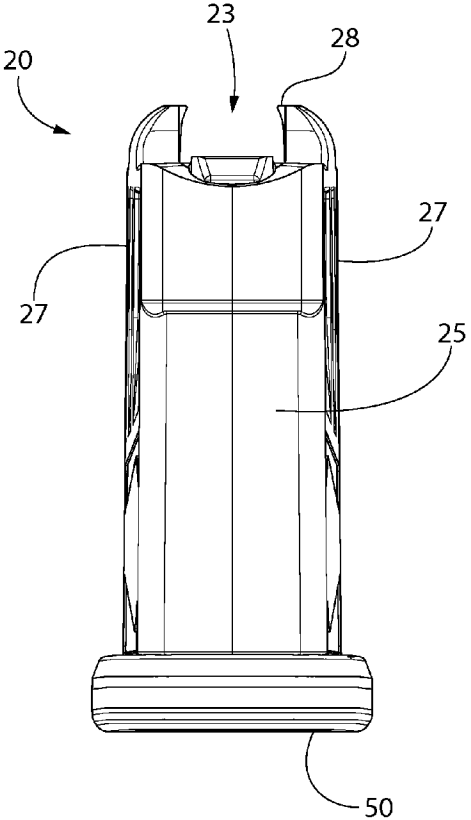
Figure 21:
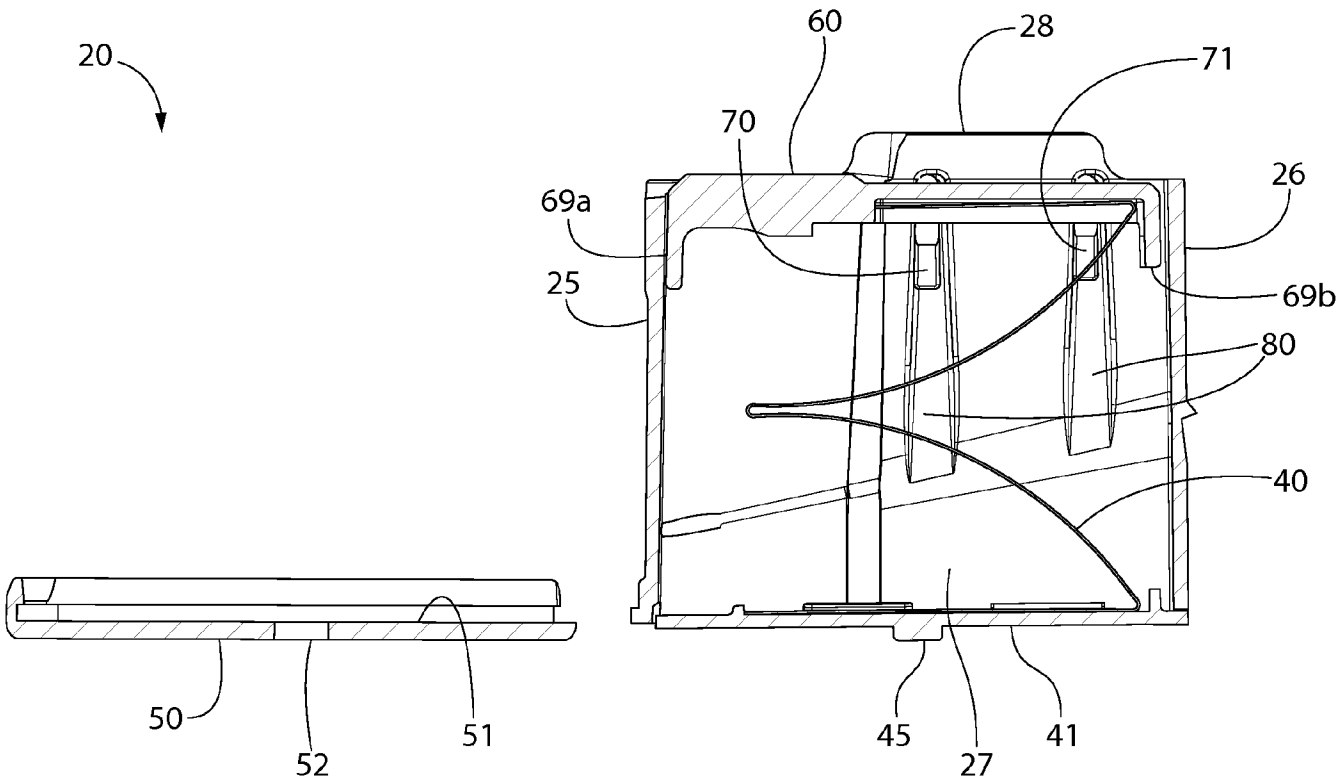
FIG. 21 is a left side cross-sectional view of the magazine showing the follower in an upper position in the magazine.
Figure 22:
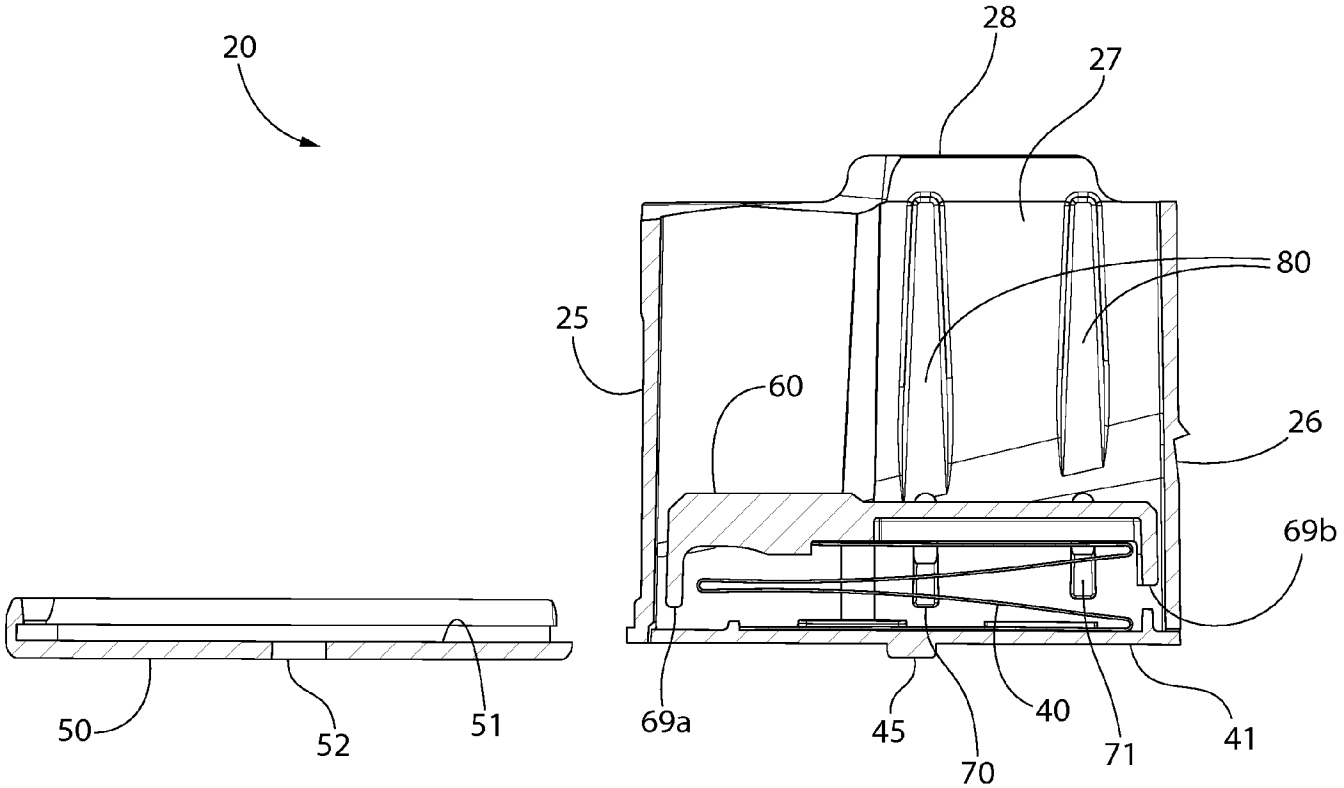
FIG. 22 is a left cross-sectional view thereof showing the follower in a lower position in the magazine.
Figure 23:
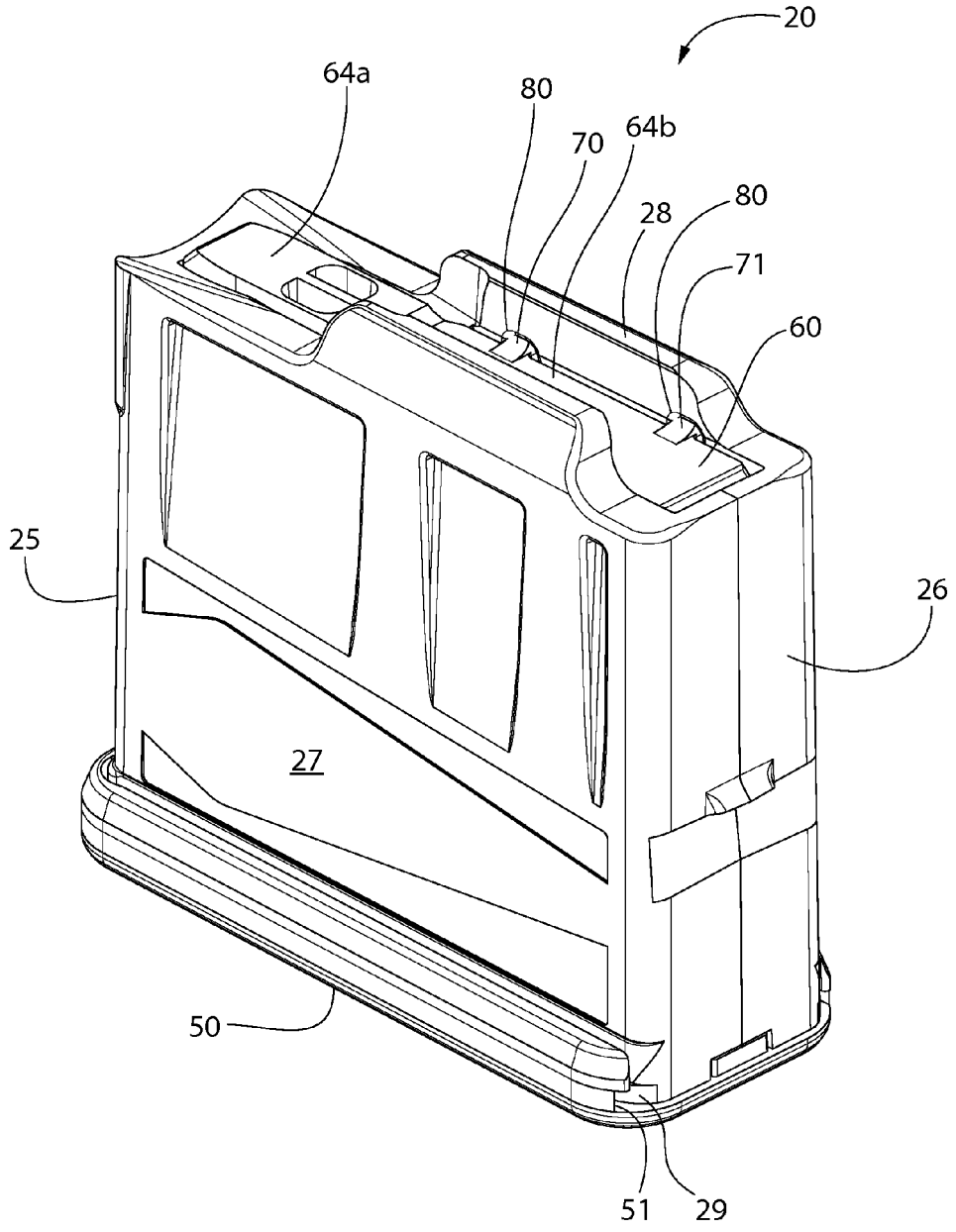
FIG. 23 is a top perspective view of the magazine without cartridges.
Figure 25:
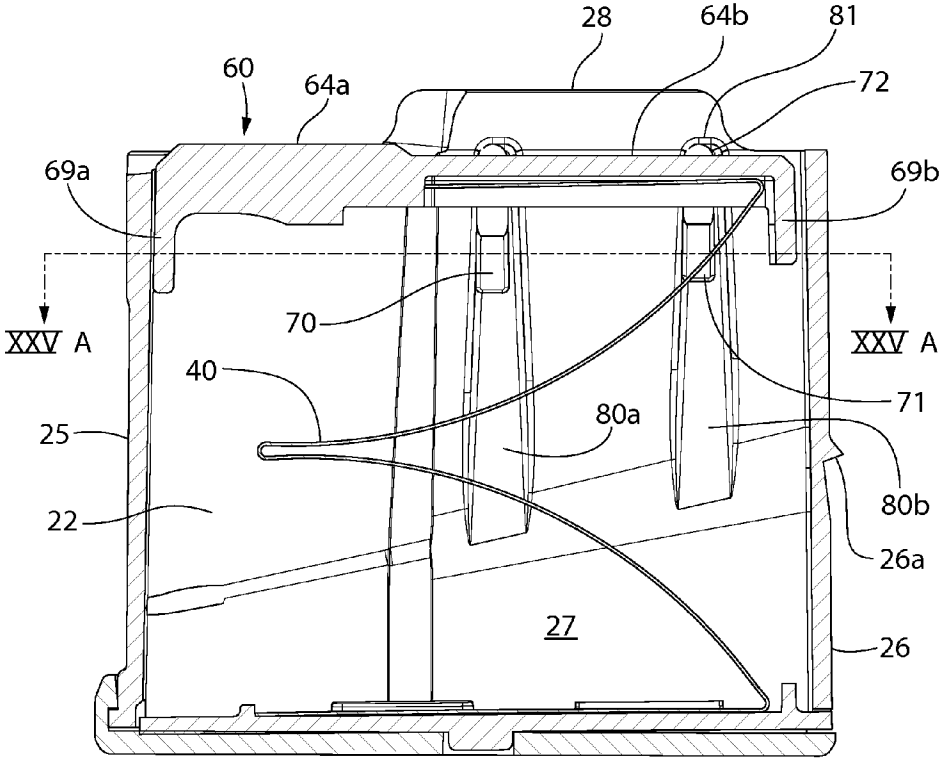
FIG. 25 is a longitudinal left side cross-sectional view thereof taken along lines XXV-XXV in FIG. 24.
Figure 24:
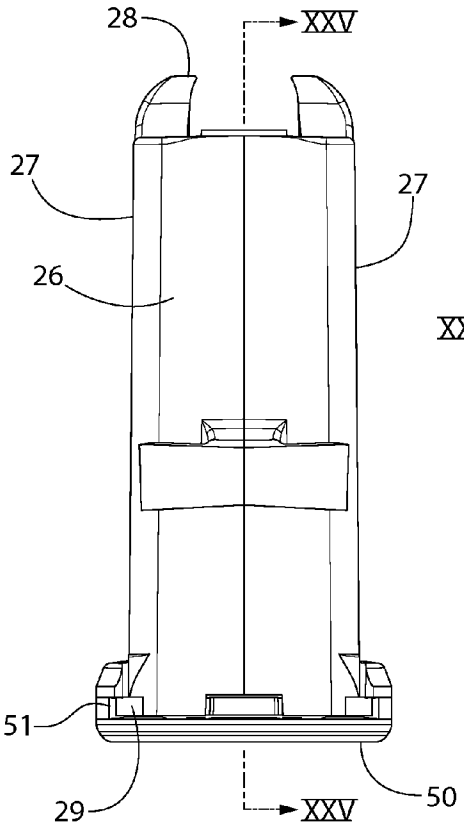
FIG. 24 is a rear view thereof.
Figure 25A:
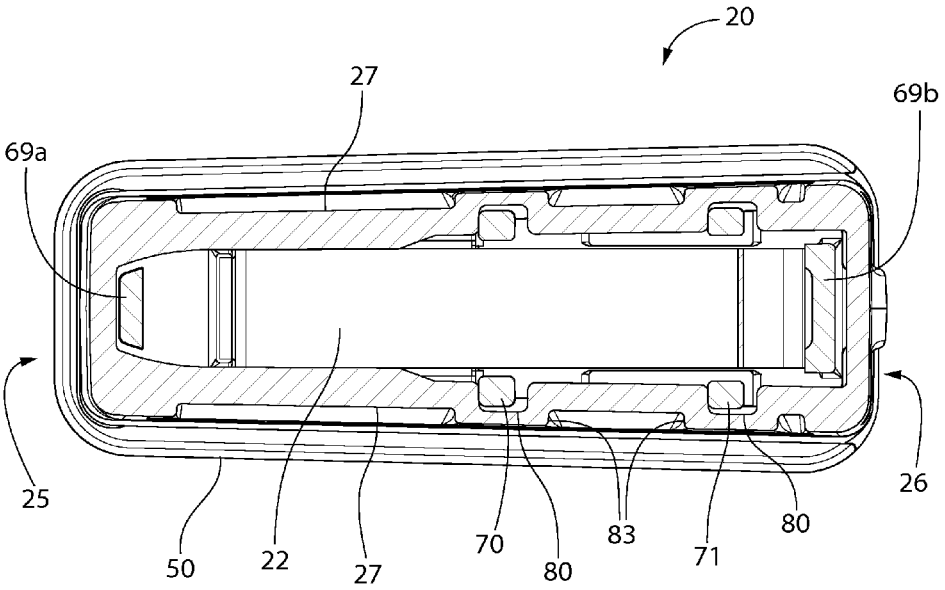
FIG. 25A is a transverse cross-sectional view thereof taken along lines XXVA-XXVA in FIG. 25 and showing lateral guide projections position within guide slots form in the magazine wall.
Figure 31:
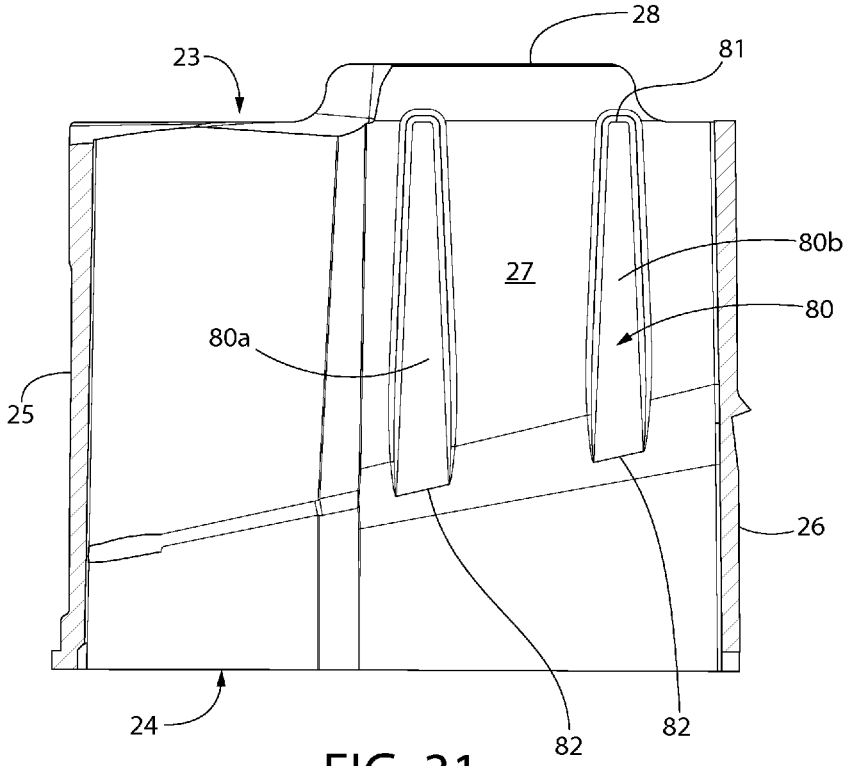
FIG. 31 is a longitudinal left side cross-sectional view thereof.
Figure 32:
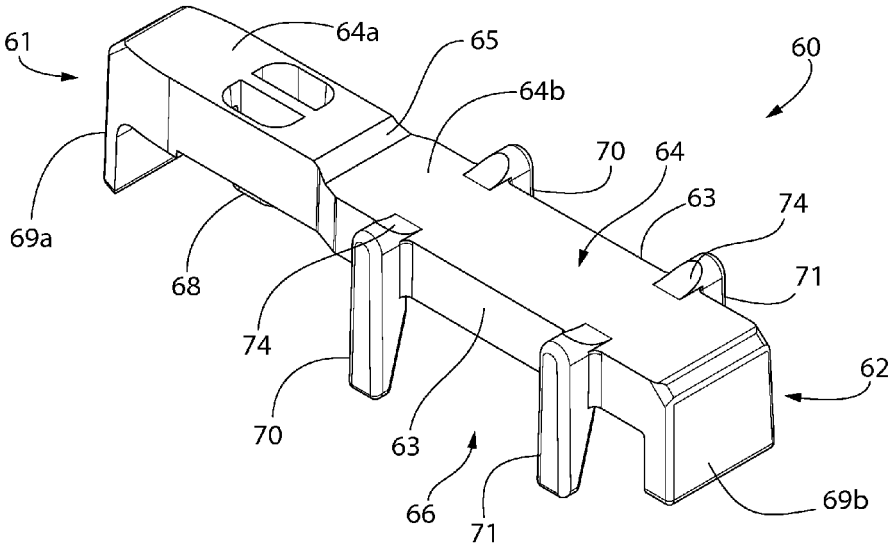
FIGS. 32-40 are top perspective, bottom perspective, left side, right side, front, rear, top plan, bottom plan, and longitudinal cross-sectional views respectively of the follower.

The guide projections 70, 71 each slide upwards/downwards in mating vertically elongated, guide slots 80 formed inside the cavity 22 of the magazine 20 in the sidewalls 27 (reference FIGS. 21, 22, 25, 25A, 29-31). The slots 80 are therefore recessed into the inner surface of the magazine sidewalls 27 as shown (FIG. 16). In one embodiment, outwardly extending columnar protrusions 83 may be formed in sidewalls 27 of the magazine body 21 into which the slots 80 are formed (see, e.g. FIGS. 1 and 25A) The cavity 22 of the magazine body 21 has a greater lateral width at the slots 80 than at other portions of the inner surface. In one embodiment, the outermost peripheral portion of each guide projection engages its respective slot. The slots 80*a* associated with the front guide projections 70 may be considered front guide slots and slots 80*b* associated with the rear guide projections 71 may be considered rear guide slots (FIGS. 25 and 31).

When the guide projections 70, 71 travel fully upward in the slot 80, engagement between the top end 78 of each guide projection on upward extension 72 and the corresponding closed top end 81 of each slot acts as a travel limit or stop to restrict the maximum upward movement of the spring-biased follower 60 in the magazine 20. In one implementation, the top ends 81 of the slots 80 may be flat and the top ends 78 of the guide projections 70, 71 may be arcuately curved to create a curved-to-flat surface contact with the top end 81 surfaces of the slots thereby assuring smooth engagement even if the follower is not perfectly horizontal at the upper limit of its travel.

In one embodiment, the guide slots 80 may get axially larger or wider going towards the bottom 24 of the magazine. This forms a wider bottom entrance 82 to each slot than the closed top ends 81 allowing easier insertion and assembly of the follower into the magazine from the open bottom. The use of two pairs of slots 80 and guides 70, 71 on each lateral side of the follower helps compensate for potential twisting or tilting of the follower 60 transversely to the longitudinal axis LA in the bottom portion of the magazine 20 near the wider slot entrances. In one embodiment, the slots 80 may each have a frustoconical shape in side view with a wide bottom entrance 82 portion and a narrower top 81 portion.

The follower 60 is vertically moveable between an upper position (FIG. 21) when the magazine is empty and a lower position (FIGS. 12 and 22) when the magazine is fully loaded with cartridges. As each cartridge in the stack is dispensed when discharging the firearm, the follower 60 moves progressively and sequentially upward toward the top end 23 of the magazine 20 with its motion guided by the guide projection 70, 71 and slot 80 system. The upward biasing force of the spring 40 maintains the follower in the upper position when the magazine is empty.

In one embodiment, the guide slots 80 may terminate above the bottom end 24 of the magazine body 21 such that the entrances 82 are vertically spaced apart from the bottom end (see, e.g. FIG. 31). When the follower 60 is in the lower position shown in FIG. 22, at least one pair of the guide projections 70, 71 are positioned outside of and below its respective slot entrances 82. The front slot 80 may be longer or taller than the rear slot in the illustrated embodiment such that the from guide projection 70 is positioned at the entrance 82 to its slot 80, and the rear guide projection 71 is spaced below its slot. In other possible embodiments, the guide slots 80 may extend for the entire height of the magazine body 21 from the top end 23 to the bottom end 24 such that the guide projections 70, 71 remain in the slots when the follower 60 is in the lower position. In yet other embodiments, the guide projections 80 may have a height such that both front and rear guide projections 70, 71 may be positioned below the guide slots when the follower 60 is in the lower position. Accordingly, both guide projections could be below the slots, or both guide projections could remain still in the slots at the bottom lower position of the follower.

In certain embodiments, the follower 60 may further include front and rear stabilizer projections 69*a*, 69*h* (see, e.g. FIGS. 32-40). These projections protrude axially outwards at the front and rear ends 61, 62 of the follower and further guide movement of the follower to resist axial twisting/tilting by engaging the front and rear walls 25, 26 inside the magazine cavity respectively. The stabilizer projections 69*a*, 69*b* extend vertically downwards below the bottom edge 75 of the follower. In one embodiment, the front stabilizer projection 69*a* may have a greater height than the rear stabilizer projection 69*b*. In one embodiment arrangement, the front stabilizer projection 69*a* ma have a height equal to the height H1 of the front lateral guide projections 70 with bottom ends terminating in the same horizontal plane.

In one embodiment, some or all of the bottom ends 76 of the lateral guide projections 70, 71 and/or the bottom ends 77 of front and rear stabilizer projections 69*a*, 69*b* may be configured and arranged to engage one or more upward facing horizontal stop surfaces 41*a* formed proximate the peripheral edges of the spring retainer plate 41 (see, e.g. FIG. 4), or alternatively the floor plate 50 in embodiments of a compact magazine that lack a retainer. This limits the maximum downward movement of the follower 60 when the magazine is fully loaded with cartridges, maintains a substantially horizontal follower orientation when the follower is bottomed out, and prevents over compressing the spring 40.

It bears noting the lateral guide projections 70 and 71 of the follower act to resist lateral side-to-side twisting/tilting about the centerline CL of the magazine and also longitudinal end-to-end canting of the follower with respect to the front and rear walls 25, 26 of the magazine. Accordingly, the top surface 64 of the follower 60 stays horizontal left to right and front to rear. The front and rear stabilizer projections 69*a*, 69*b* further aid to prevent end-to-end canting of the follower 60.

Referring now to FIGS. 41-43, the alternative embodiment of a follower having a single pair of front lateral guide projections mentioned above will now be discussed. This follower 160 has two front guide projections 70; however, the rear guide projections are omitted. To provide commensurate stability and anti-twisting/tilting motion of the follower in the magazine as a follower with two pairs of lateral guide projections, a bifurcated rear stabilizer projection 100 is provided. Projection 100 comprises a pair of laterally spaced apart flanges 101 which protrude in a rearward direction from the rear end of the follower. A rearwardly open vertical slot 102 is formed between the flanges which is received, by a vertically extending ridge 103 formed in the rear wall 26 of the magazine body 21 inside the interior cavity 22. During movement of the follower 160 between the top upper position and bottom lower position in the magazine 20, the slot 102 rides up and down along the rail preventing lateral side-to-side twisting of the follower. Accordingly, the bifurcated rear stabilizer 100 prevents twisting so the follower top stays horizontal left to right and prevents canting so the follower top stays horizontal front to rear (similar function to the rear stabilizer 69*b* shown in FIGS. 32-40). Combined with the front lateral guide projections 70, the follower 160 helps provide an upward travel stop when no cartridges are in the magazine and the follower is in the upper position.

Figure 12:
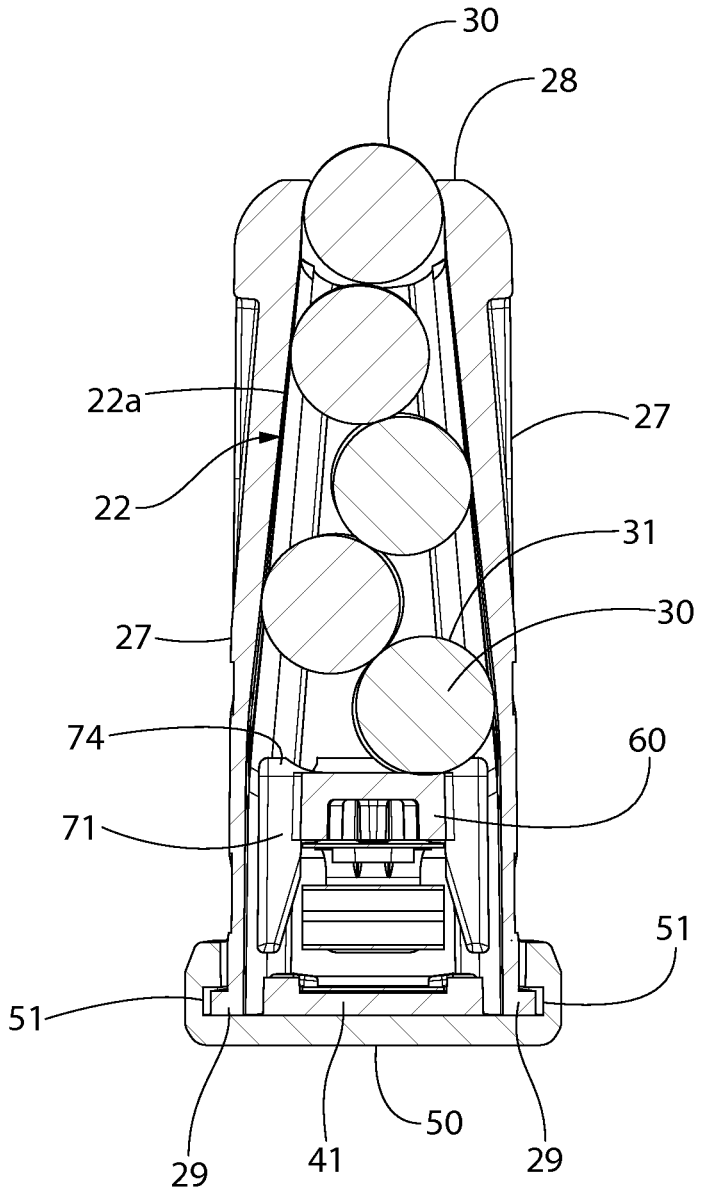
FIG. 12 is a transverse cross-sectional view thereof taken along line XII-XII in FIG. 6.
Figure 13:
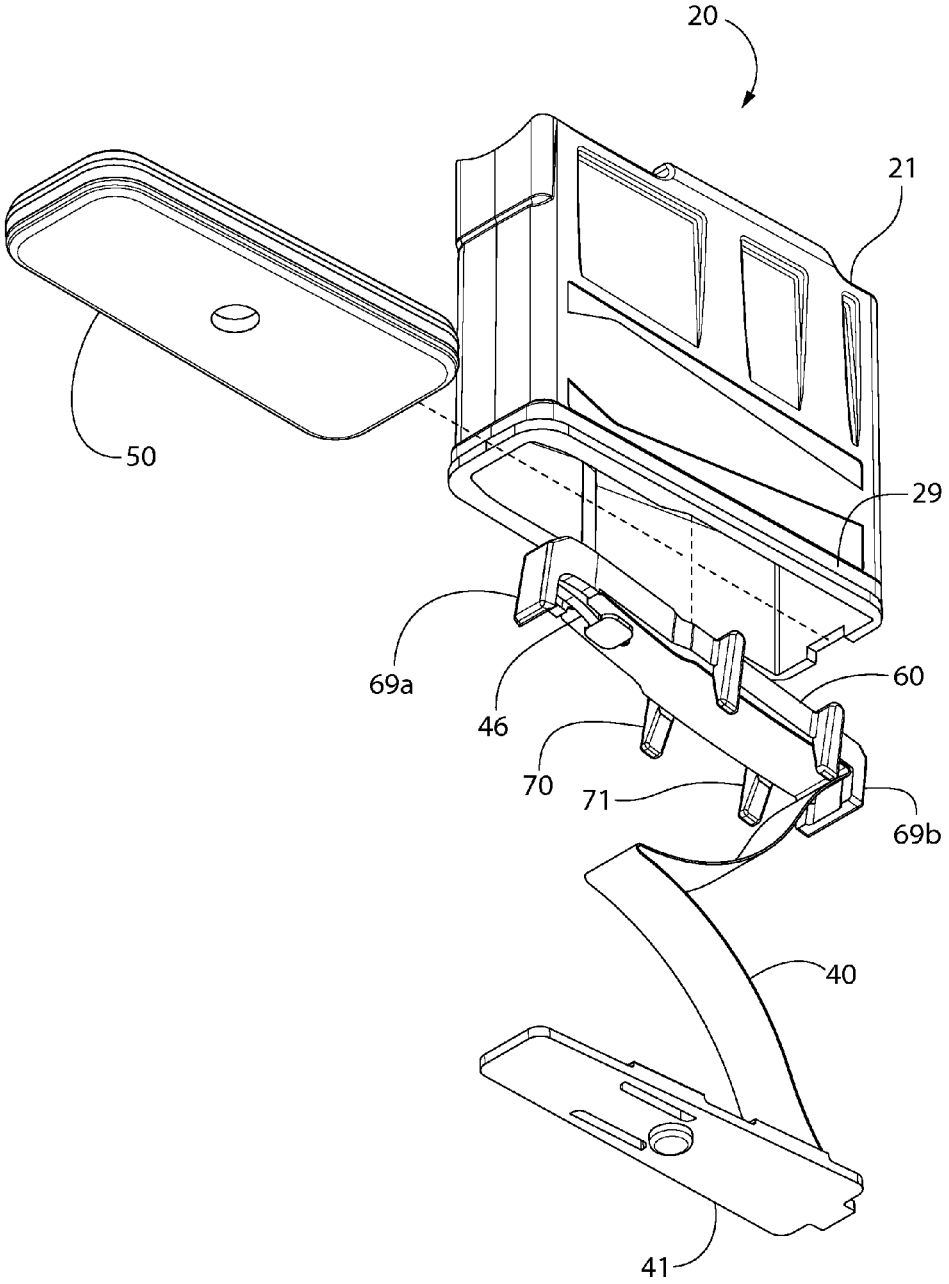
FIG. 13 is an exploded bottom perspective view of the magazine and cartridge feed mechanism including follower, spring, and spring retainer plate.
Figure 14:
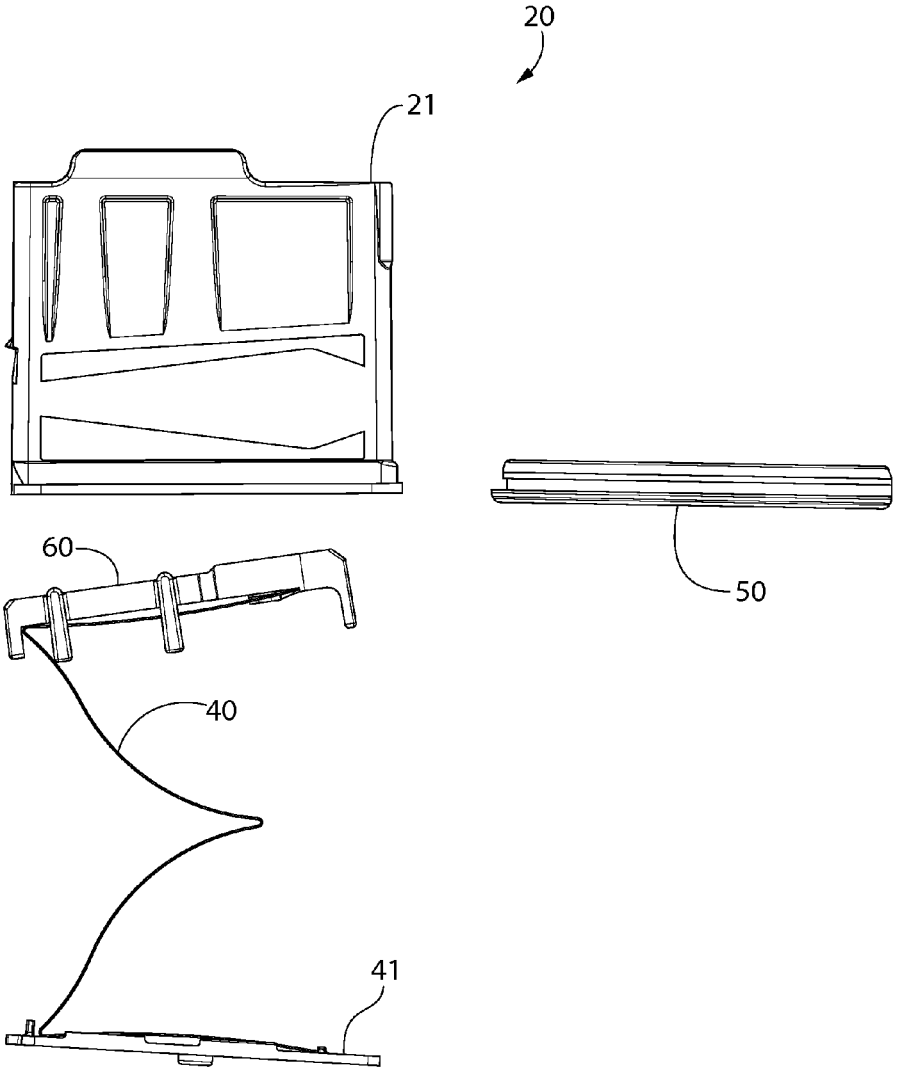
FIG. 14 is a right side view thereof.
Figure 15:
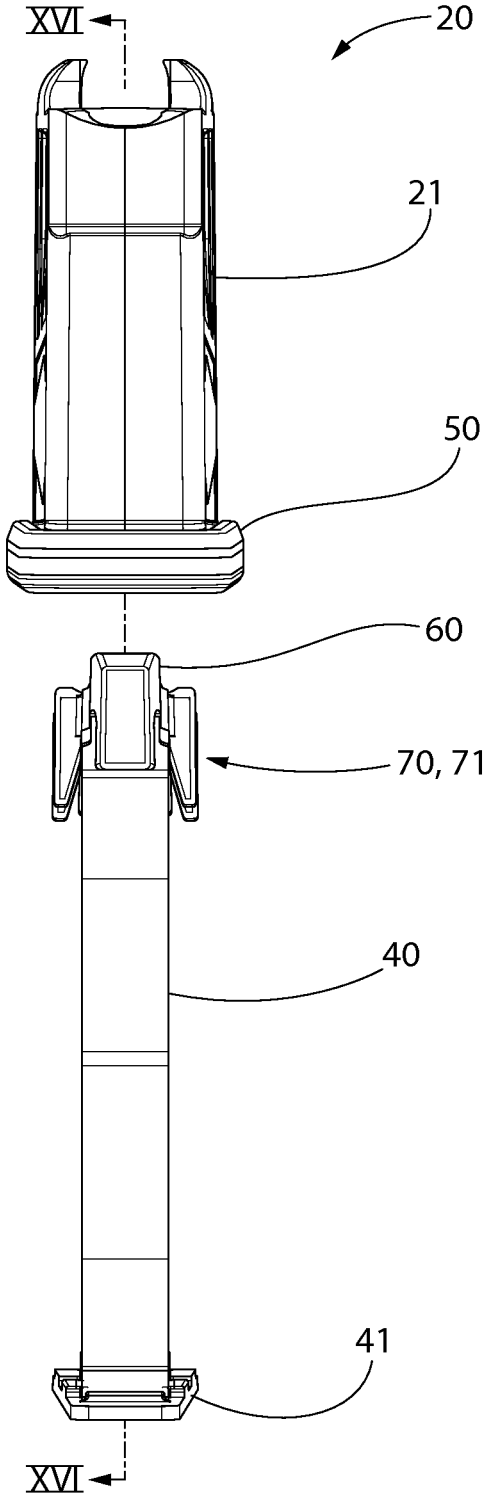
FIG. 15 is a front elevation view thereof.

Referring to FIG. 12, it is shown that the follower 60 has a width greater than a width of a case 31 of a single cartridge 30 such that a lowermost cartridge case when positioned on the follower contacts only a single pair of front and rear guide projections 70, 71 (i.e. upward extensions 72) on one of the lateral sides 63 of the follower, and not the other side. This provides a staggered vertical stack arrangement of the cartridges. Accordingly, the lateral width of the follower measured across the top surface 64 between lateral sides 62 in the rear portion 64*b* of the top surface 64 may be larger than the width of single cartridge case 31. This width may further be larger than the lateral width measured between the lateral sides 63 in the front upper surface portion 64*a* of the top surface (see, e.g. FIG. 38). In other embodiments shown in FIG. 43 for a single vertically aligned stack of cartridges 30, the lateral width of the top surface of the follower 160 may be equal for the entire length of the follower top surface such that the lowermost cartridge case 31 would contact both front lateral guide projections 70.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A magazine for a firearm comprises:

an elongated tubular body defining a vertical centerline, a longitudinal axis perpendicular thereto, and an interior cavity configured to hold a plurality of ammunition cartridges, the body including an open top end, a bottom end, a front wall, a rear wall, and opposed lateral sidewalls extending along the longitudinal axis between the front and rear walls;

a spring disposed in the cavity;

a follower moveably disposed in the cavity and biased in an upwards direction towards the top end by the spring;

the follower including a longitudinally extending body, a front end, a rear end, and opposed lateral sides extending along the longitudinal axis between the front and rear ends; and a longitudinally spaced apart pair of front and rear guide projections protruding outwards from each of the lateral sides of the follower in a direction transverse to the longitudinal axis, each guide projection slideably engaging a corresponding vertically elongated guide slot formed in the sidewalls of the tubular body within the cavity for guiding movement of the follower;

wherein the follower is moveable from a lower position in the cavity to an upper position in the cavity;

wherein the front and rear guide projections each include an upward extension protruding upwards above a top surface of the follower and a downward extension protruding downwards below a bottom edge of the follower.

2. The magazine according to claim 1, wherein the front and rear guide projections are positioned in a corresponding slot when the follower is in the upper position, and the rear guide projections are positioned below a corresponding slot when the follower is in the lower position.

3. The magazine according to claim 2, wherein the slots associated with the front guide projections are vertically longer than the slots associated with the rear guide projections.

4. The magazine according to claim 1, wherein the upward extensions define an inward facing arcuately curved cartridge support surface that engage a case of the cartridge when inserted in the magazine.

5. The magazine according to claim 1, wherein the front and rear guide projections have a height greater than a height of the follower where the guide projections are located.

6. The magazine according to claim 5, wherein the front and rear guide projections each have a top end which is arcuately curved.

7. The magazine according to claim 1, further comprising a staggered vertical stack of cartridges disposed in the magazine, the upward extensions on only the front and rear guide projections on one of the lateral sides of the follower engaging a lowermost cartridge in the stack.

8. The magazine according to claim 1, wherein the guide slots have a frustoconical shape.

9. The magazine according to claim 1, wherein the follower includes a front stabilizer projection at the front end of the follower and a rear stabilizer projection at the rear end of the follower, the front and rear stabilizer projections extending vertically downwards below a bottom edge of the follower and engaging the front and rear walls of the tubular body respectively inside the cavity.

10. The magazine according to claim 9, wherein the front and rear stabilizer projections each have a width measured transversely to the longitudinal axis which is substantially the same as the width of the follower measured transversely to the longitudinal axis so that the stabilizer projections do not protrude laterally outwards beyond the sides of the follower.

11. The magazine according to claim 1, further comprising an enlarged boss formed on an underside of the follower, the boss trapping an upper leg of the spring between the boss and the underside of the follower.

12. The magazine according to claim 1, wherein the follower has a top surface having a stepped shape comprising a raised front upper surface portion proximate to the front end of the follower and a rear lower surface portion proximate to the rear end of the follower.

13. The magazine according to claim 12, wherein the front and rear guide projections are located adjacent to the lower surface portion.

14. The magazine according to claim 1, wherein when the follower is in the upper position, top ends of the front and rear guide projections engage closed top ends of the guide slots to limit upward movement of the follower in the cavity.

15. The magazine according to claim 1, wherein the follower has a width greater than a width of a case of a single cartridge such that a lowermost cartridge case when positioned on the follower contact only a single pair of front and rear guide projections on one of the lateral sides of the follower.

16. A firearm magazine comprising:

an elongated tubular body defining a vertical centerline, a longitudinal axis perpendicular thereto, and an interior cavity configured to store a plurality of ammunition cartridges, the body including an open top end, a bottom end, a front wall, a rear wall, and first and second opposing lateral sidewalls extending along the longitudinal axis between the front and rear walls;

a spring disposed in the cavity;

a follower moveably disposed in the cavity and biased in an upwards direction towards the top end by the spring;

the follower including a longitudinally extending body, a front end, a rear end, and opposed lateral sides extending along the longitudinal axis between the front and rear ends;

a front stabilizer projection extending downwards from the front end of the follower;

a rear stabilizer projection extending downwards from the rear end of the follower; and a first lateral guide projection formed on the first lateral sidewall of the follower;

a second lateral guide projection formed on the second lateral sidewall of the follower opposite the first lateral guide projection;

each of the first and second lateral guide projections slideably engaging a respective vertically elongated guide slot formed in the first and second sidewalls of the tubular body within the cavity for guiding movement of the follower;

wherein the first and second lateral guide projections are vertically moveable in the guide slots when the follower is moved from a lower position to an upper position in the cavity;

wherein the first and second lateral guide projections each include a downward extension protruding downwards below a bottom edge of the follower;

wherein the first and second lateral guide projections each include an upward extension protruding upwards above a top surface of the follower where the first and second guide projections are located.

17. The magazine according to claim 16, wherein the upward extensions each define an inward facing arcuately curved cartridge support surface that engages a case of the cartridge when inserted in the magazine.

18. The magazine according to claim 16, further comprising:

a third lateral guide projection formed on the first lateral sidewall of the follower;

a fourth lateral guide projection formed on the second lateral sidewall of the follower opposite the third lateral guide projection;

each of the third and fourth lateral guide projections slideably engaging a respective vertically elongated guide slot formed in the first and second sidewalls of the tubular body within the cavity.

19. The magazine according to claim 16, wherein the follower has a top surface having a stepped shape comprising a raised front upper surface portion proximate to the front end of the follower and a rear lower surface portion proximate to the rear end of the follower.

20. The magazine according to claim 19, wherein the upper surface portion has a smaller lateral width than the lower surface portion.

21. A firearm magazine comprising:

an elongated tubular body defining a vertical centerline, a longitudinal axis perpendicular thereto, and an interior cavity configured to hold a plurality of ammunition cartridges, the body including an open top end, a bottom end, a front wall, a rear wall, and opposed lateral sidewalls extending along the longitudinal axis between the front and rear walls;

a spring disposed in the cavity;

a follower moveably disposed in the cavity and biased in an upwards direction towards the top end by the spring;

the follower including a longitudinally extending body, a front end, a rear end, and opposed lateral sides extending along the longitudinal axis between the front and rear ends; and a front stabilizer projection extending downwards from the front end of the follower;

a rear stabilizer projection extending downwards from the rear end of the follower; and a longitudinally spaced apart pair of front and rear guide projections protruding outwards from each of the lateral sides of the follower in a direction transverse to the longitudinal axis, each guide projection slideably engaging a corresponding vertically elongated guide slot formed in the sidewalls of the tubular body within the cavity for guiding movement of the follower;

wherein the front and rear guide projections each include an upward extension protruding upwards above a top surface of the follower and a downward extension protruding downwards below a bottom edge of the follower;

wherein the follower is moveable from a lower position in the cavity to an upper position in the cavity.

22. The magazine according to claim 21, wherein the follower has a front portion adjoining the front end having a first width and a rear portion adjoining the rear having a second width larger than the first width, the front and rear guide projections located on the rear portion.

* * * * *